US010034589B2

(12) United States Patent
Kawamura et al.

(10) Patent No.: US 10,034,589 B2
(45) Date of Patent: Jul. 31, 2018

(54) ELECTRIC VACUUM CLEANER

(71) Applicant: TOSHIBA LIFESTYLE PRODUCTS & SERVICES CORPORATION, Ome-shi (JP)

(72) Inventors: Naoko Kawamura, Owariasahi (JP); Yasuhiro Ohtsu, Owariasahi (JP); Yukio Machida, Owariasahi (JP); Tsutomu Inoue, Owariasahi (JP); Atsushi Morishita, Seto (JP)

(73) Assignee: TOSHIBA LIFESTYLE PRODUCTS & SERVICES CORPORATION, Ome-shi (JP)

( * ) Notice: Subject to any disclaimer, the term of this patent is extended or adjusted under 35 U.S.C. 154(b) by 0 days.

(21) Appl. No.: 15/033,170

(22) PCT Filed: Nov. 7, 2014

(86) PCT No.: PCT/JP2014/079613

§ 371 (c)(1),
(2) Date: Apr. 29, 2016

(87) PCT Pub. No.: WO2015/068816

PCT Pub. Date: May 14, 2015

(65) Prior Publication Data

US 2016/0270615 A1 Sep. 22, 2016

(30) Foreign Application Priority Data

Nov. 7, 2013 (JP) ..... 2013-231242
Nov. 11, 2013 (JP) ..... 2013-233530

(51) Int. Cl.
*A47L 9/16* (2006.01)
*A47L 9/32* (2006.01)
(Continued)

(52) U.S. Cl.
CPC ..... *A47L 9/1683* (2013.01); *A47L 5/225* (2013.01); *A47L 5/24* (2013.01); *A47L 5/28* (2013.01);
(Continued)

(58) Field of Classification Search
CPC .... A47L 9/1683; A47L 9/1633; A47L 9/1641; A47L 9/1658; A47L 9/322; A47L 5/225;
(Continued)

(56) References Cited

U.S. PATENT DOCUMENTS 7,547,336 B2 * 6/2009 Fester ..... A47L 9/122 55/337
7,556,662 B2 7/2009 Lee et al.
(Continued)

FOREIGN PATENT DOCUMENTS

CN 101836848 A 9/2010
CN 102302351 A 1/2012
(Continued)

OTHER PUBLICATIONS

Office Action dated Mar. 7, 2016 in corresponding Chinese Application 201480003276.3, filed Nov. 7, 2014 (with English translation).
(Continued)

*Primary Examiner* — Dung Van Nguyen
(74) *Attorney, Agent, or Firm* — Oblon, McClelland, Maier & Neustadt, L.L.P.

(57) ABSTRACT

An electric vacuum cleaner that secures efficiency and quietness without increasing the size of a main body part. The electric vacuum cleaner includes an electric blower, and a main body part including a first centrifugally separating part that centrifugally separates dust from air containing dust sucked by the electric blower. The first centrifugally separating part includes a dust collecting cup including a dust
(Continued)

collecting cup main body that is formed into a bottomed cylindrical shape and turns air containing dust inside, and an exhaust tube part that is formed along the central axis of the dust collecting cup main body and discharges exhaust air of the electric blower from the bottom portion.

13 Claims, 17 Drawing Sheets

(51) Int. Cl.

| | |
|---|---|
| ***A47L 5/22*** | (2006.01) |
| ***A47L 5/24*** | (2006.01) |
| ***A47L 5/28*** | (2006.01) |
| ***A47L 9/00*** | (2006.01) |
| ***A47L 9/22*** | (2006.01) |

(52) U.S. Cl.
CPC ..... *A47L 9/0081* (2013.01); *A47L 9/16* (2013.01); *A47L 9/1608* (2013.01); *A47L 9/1625* (2013.01); *A47L 9/1633* (2013.01); *A47L 9/1641* (2013.01); *A47L 9/1658* (2013.01); *A47L 9/1691* (2013.01); *A47L 9/22* (2013.01); *A47L 9/322* (2013.01)

(58) Field of Classification Search
CPC . A47L 5/24; A47L 9/0081; A47L 9/16; A47L 9/1608; A47L 9/1625; A47L 9/1691; A47L 9/22; A47L 5/05; A47L 5/28
See application file for complete search history.

(56) References Cited

U.S. PATENT DOCUMENTS

| | | | | |
|---|---|---|---|---|
| 8,302,250 | B2 | 11/2012 | Dyson et al. | |
| 8,347,455 | B2 | 1/2013 | Dyson et al. | |
| 8,387,204 | B2 | 3/2013 | Dyson | |
| 8,495,788 | B2 * | 7/2013 | Tran | A47L 9/1472 15/327.6 |
| 8,671,512 | B2 | 3/2014 | Qian et al. | |
| 2004/0025285 | A1 * | 2/2004 | McCormick | A47L 9/1608 15/352 |
| 2005/0072130 | A1 * | 4/2005 | Yang | A47L 9/1666 55/429 |
| 2006/0162299 | A1 * | 7/2006 | North | B04C 5/081 55/345 |
| 2006/0168923 | A1 | 8/2006 | Lee et al. | |
| 2006/0230715 | A1 | 10/2006 | Oh et al. | |
| 2007/0175185 | A1 * | 8/2007 | Kim | B01D 50/002 55/337 |
| 2008/0229539 | A1 * | 9/2008 | Hwang | A47L 5/30 15/346 |
| 2009/0265877 | A1 | 10/2009 | Dyson et al. | |
| 2009/0307864 | A1 | 12/2009 | Dyson | |
| 2010/0229321 | A1 | 9/2010 | Dyson et al. | |
| 2010/0236014 | A1 | 9/2010 | Fester et al. | |
| 2010/0242221 | A1 | 9/2010 | Horne et al. | |
| 2011/0023261 | A1 * | 2/2011 | Proffitt, II | A47L 9/1608 15/347 |

FOREIGN PATENT DOCUMENTS

| | | | |
|---|---|---|---|
| EP | 1 681 099 | A2 | 7/2006 |
| EP | 1 681 099 | A3 | 7/2006 |
| EP | 1 688 078 | A2 | 8/2006 |
| EP | 1 688 078 | A3 | 8/2006 |
| JP | 2006-205162 | A | 8/2006 |
| JP | 2010/240452 | A | 10/2010 |
| JP | 2011-524215 | A | 9/2011 |
| JP | 2012-115692 | A | 6/2012 |
| KR | 10-0594589 | B1 | 6/2006 |
| KR | 10-2009-0034951 | A | 4/2009 |
| WO | WO 02/28260 | A1 | 4/2002 |
| WO | WO 2005/041739 | A1 | 5/2005 |
| WO | WO 2008/009883 | A1 | 1/2008 |
| WO | WO 2009/026714 | A1 | 3/2009 |

OTHER PUBLICATIONS

International Search Report dated Feb. 17, 2015 in PCT/JP2014/079613 filed Nov. 7. 2014.
Extended European Search Report dated Jun. 19. 2017 in Patent Application No. 14860963.9.

* cited by examiner

ELECTRIC VACUUM CLEANER

TECHNICAL FIELD

The present invention relates to an electric vacuum cleaner including a separating part that turns air containing dust to centrifugally separate the dust.

BACKGROUND ART

Conventionally, for example, an electric vacuum cleaner capable of performing cleaning while being carried includes a main body part including an electric blower and a dust collecting part, etc., and an air passage body such as an extension tube connected to the main body part. While the entire electric vacuum cleaner is carried by gripping a grip handle of the main body part, the electric vacuum cleaner performs cleaning by sucking dust into the dust collecting part from the air passage body by a negative pressure generated by driving of the electric blower.

In the case of such an electric vacuum cleaner capable of being carried, in terms of easiness of carrying, it is preferable that the size of the main body part is minimized to the extent possible. Therefore, in this main body part, it is not easy to secure a space for an exhaust air passage for efficiently discharging exhaust air from the electric blower. In addition, in the electric vacuum cleaner, wind noise and vibration, etc., are caused as noise by high-speed rotation of the centrifugal fan of the electric blower, and such noise is easily sensed by a user, so that it has been demanded to minimize such noise to the extent possible. To reduce such noise, securing an exhaust air passage is effective, however, as described above, it is not easy to secure an exhaust air passage in the case where the main body part is downsized.

CITATION LIST

Patent Literature

PTL 1: Japanese Laid-open Patent Publication No. 2011-524215

PTL 2: Japanese Laid-Open Patent Publication No. 2012-115692

SUMMARY OF INVENTION

Technical Problem

A problem to be solved by the present invention is to provide an electric vacuum cleaner capable of securing efficiency and quietness without increasing the size of the main body part.

Solution to Problem

An electric vacuum cleaner according to an embodiment includes a main body part including an electric blower and an upstream side separating part that centrifugally separates dust from air containing dust sucked by the electric blower. The upstream side separating part includes a cup part including a storage part that is formed into a bottomed cylindrical shape and turns air containing dust inside, and a discharge part that is formed along the central axis of the storage part and discharges exhaust air of the electric blower from the bottom portion.

DESCRIPTION OF EMBODIMENTS

Hereinafter, a constitution of a first embodiment will be described with reference to FIG. 1 to FIG. 8.

Figure 1:
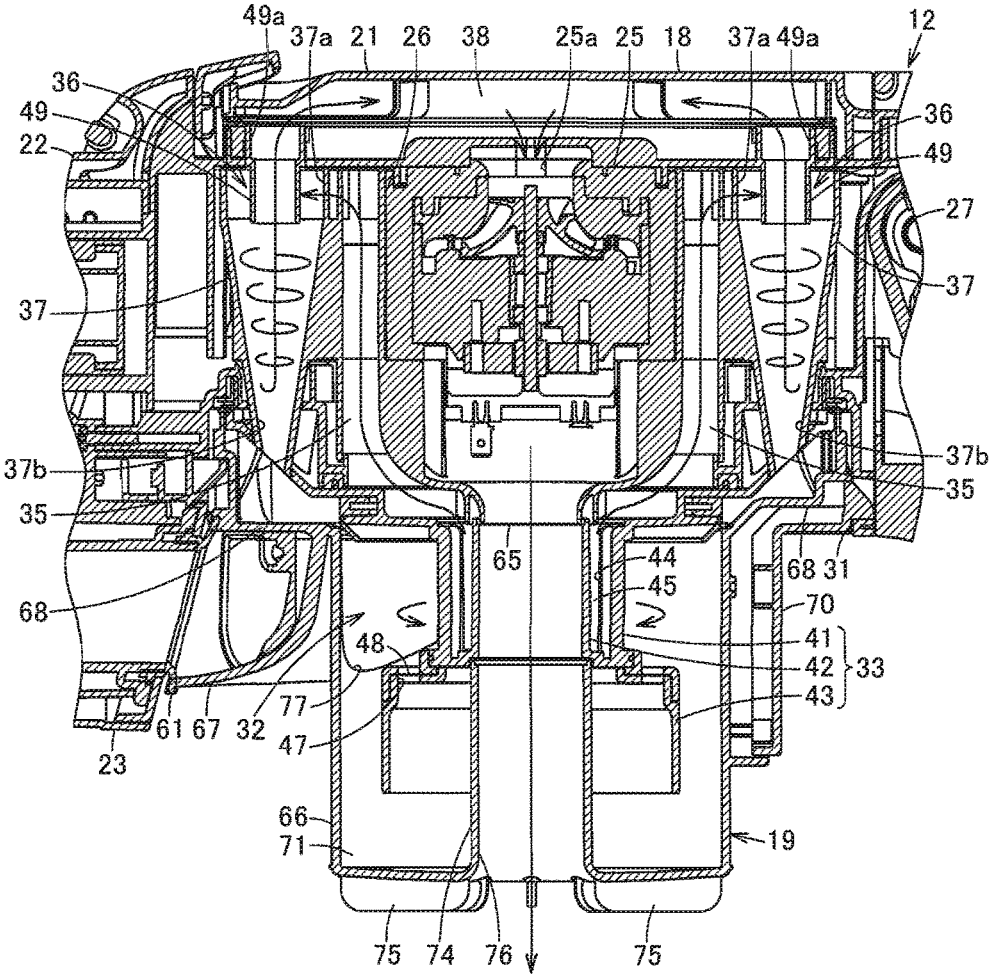
FIG. 1 is a sectional view showing a portion of a main body part of an electric vacuum cleaner according to a first embodiment.
Figure 2:
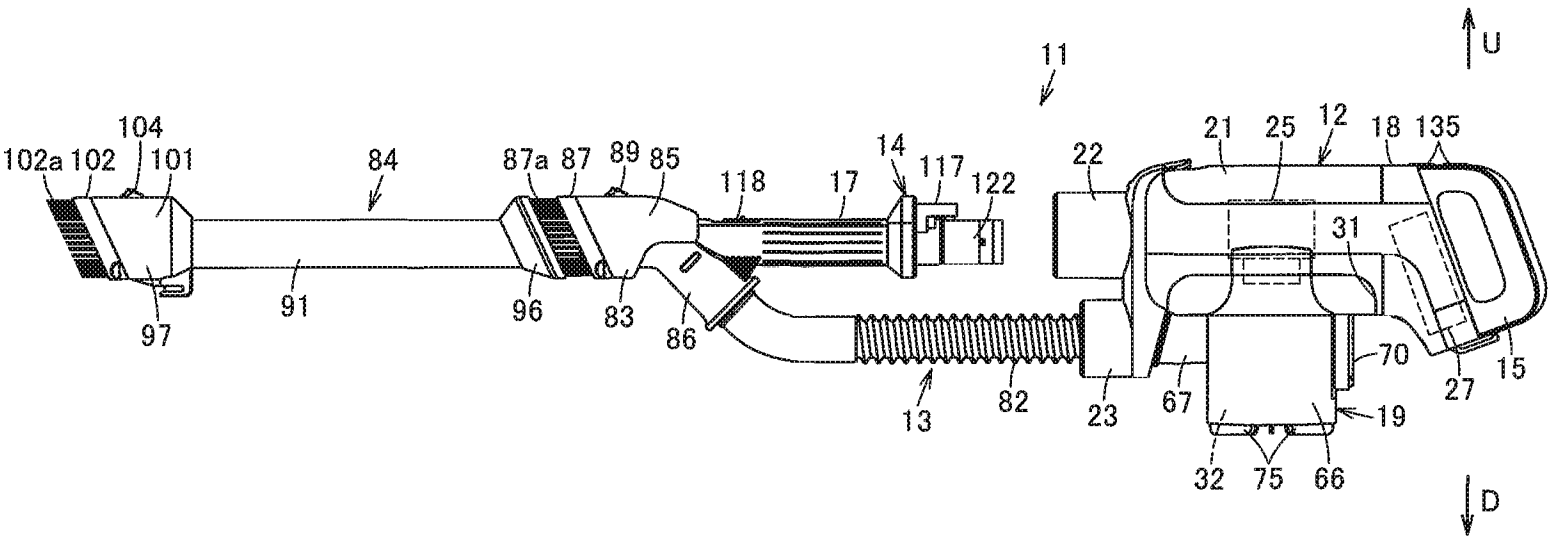
FIG. 2 is a side view showing a usage state of the same electric vacuum cleaner where an air passage body is detached from a main body part at the position of a holder part.
Figure 3:
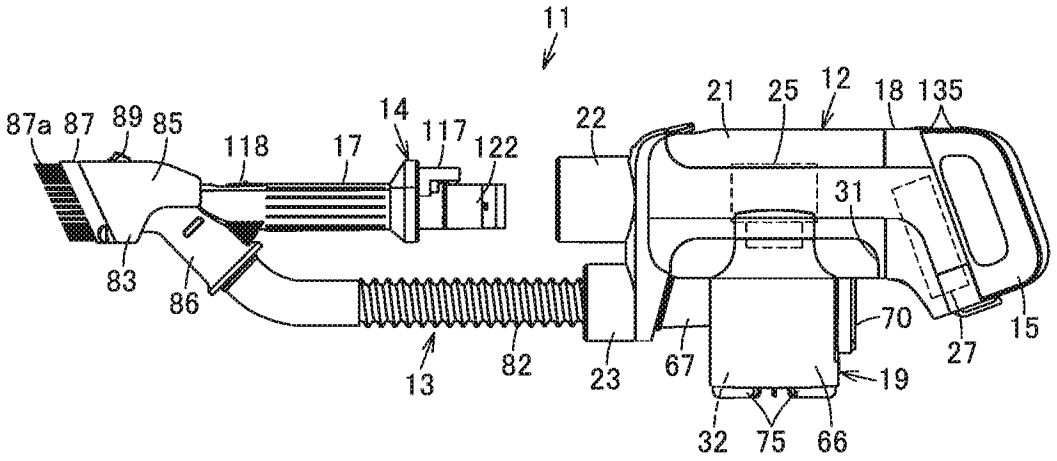
FIG. 3 is a side view showing another usage state of the same electric vacuum cleaner where the air passage body is detached from the main body part at the position of the holder part.

In FIG. 1 to FIG. 8, the reference symbol 11 denotes an electric vacuum cleaner, and for this electric vacuum cleaner 11, a mode in which the electric vacuum cleaner is used as a stick cleaner (upright cleaner) while being entirely moved as shown in FIG. 4 to FIG. 8 and a mode in which the electric vacuum cleaner is used as a handy cleaner while a portion thereof is carried as shown in FIG. 2 and FIG. 3 can be arbitrarily selected.

As shown in FIG. 1 to FIG. 8, this electric vacuum cleaner 11 includes a main body part 12 and an air passage body 13 connected to the main body part 12, and this air passage body 13 can be held with respect to the main body part 12 via a holder part 14, a main body handle 15 is provided to project from the main body part 12, and an air passage body handle 17 is provided to project from the air passage body 13. Hereinafter, the up-down direction is based on a state where the electric vacuum cleaner 11 is placed on a surface to be cleaned. That is, the arrow U direction shown in FIG. 2 shows the upward direction of the present embodiment, and the arrow D direction shows the downward direction of the present embodiment.

The main body part 12 includes a main body case 18 whose longitudinal direction is along the front-rear direction, that is, whose dimension in the front-rear direction is larger than the dimensions in the left-right width direction and the up-down direction, and a dust collecting cup 19 having a substantially bottomed cylindrical shape being a cup part as a dust storage body attachable to and detachable from the lower portion of the main body case 18.

The main body case 18 is made of, for example, synthetic resin, etc., and includes a case main body 21 longitudinal along the front-rear direction, a holder receiving part 22 provided on the upper portion of the front end portion that is an end portion in the longitudinal direction of the case main body 21, and an air passage body connecting part 23 provided on the lower portion of the front end portion of the case main body 21, that is, below the holder receiving part 22 and projects forward from the case main body 21, an electric blower 25 being a heavy load is housed inside an electric blower chamber 26, and a main body control part (not shown) that controls operation of the electric blower 25 and a secondary battery 27 that is a battery as a power supply part being a heavy load are housed in the main body case respectively. The main body handle 15 is provided integrally with the rear portion of the main body case 18 (case main body 21), and with this main body handle 15, the main body part 12 can be gripped.

In the lower portion of the case main body 21, an attaching opening part 31 which the dust collecting cup 19 is attachable to and detachable from is opened at a position at the rear of the air passage body connecting part 23. This attaching opening part 31 is opened along the up-down direction, and in this attaching opening part 31, a substantially cylindrical separating body part 33 that is inserted to the inside of the dust collecting cup 19 according to attachment of the dust collecting cup 19 to the main body case 18 (attaching opening part 31) and constitutes a first centrifugally separating part 32 being a first separating part as an upstream side separating part together with the dust collecting cup 19 is provided to project downward. Inside the case main body 21 above the attaching opening part 31, a substantially cylindrical communicating air passage part 35 that communicates with the attaching opening part 31 is partitioned at the outer circumference of the electric blower chamber 26, and outside this communicating air passage part 35, a plurality of substantially cylindrical separating cylinder parts 37 constituting second centrifugally separating parts 36 being second separating parts as a downstream-side separating part which separate dust contained in air that passed through the separating body part 33 (first centrifugally separating part 32), that is, dust smaller than dust to be separated by the first centrifugally separating part 32 are provided. Above these separating cylinder parts 37, inside the case main body 21, an air passage part 38 that communicates with these separating cylinder parts 37 (second centrifugally separating parts 36) are partitioned, and this air passage part 38 communicates with the suction side of the electric blower 25. Therefore, from the first centrifugally separating part 32 via the communicating air passage part 35, the second centrifugally separating parts 36, and the air passage part 38, an air passage that communicates with the suction side of the electric blower 25 is formed.

The first centrifugally separating part 32 centrifugally separates dust (coarse dust) by turning air between the inner circumferential surface of the dust collecting cup 19 and the outer circumferential surface of the separating body part 33. Therefore, the turning flow in the first centrifugally separating part 32 has an axial direction along the up-down direction.

The separating body part 33 is formed into a cylindrical shape whose axial direction is along the up-down direction, and disposed coaxially (concentrically) with the dust collecting cup 19. This separating body part 33 includes a cylindrical separating body part main body 41, an exhaust part 42 positioned coaxially inside the separating body part main body 41, and a cylindrical compressing part 43 having a diameter larger than that of the separating body part main body 41 so that these components approximate each other in the axial direction.

The separating body part main body 41 has a plurality of openings 44 that are opened in the circumference and communicate with the communicating air passage part 35, and a separating filter 45 that covers these openings 44. That is, the outside of the separating body part main body 41 (inside of the dust collecting cup 19) and the communicating air passage part 35 communicate with each other through the openings 44. In the first centrifugally separating part 32, air turns between the outer circumferential surface of the separating body part main body 41 and the inner circumferential surface of the dust collecting cup 19.

The exhaust part 42 is molded integrally with the separating body part main body 41 and forms a double tubular shape together with the separating part main body 41. Therefore, this exhaust part 42 has a central axis substantially parallel to the central axis of the electric blower 25, and is disposed substantially coaxially with the electric blower 25.

The compressing part 43 is also called a shade part, and is increased in diameter in a phased manner and continues to the lower end portion of the separating body part main body 41, and is disposed coaxially with the separating body part main body 41. This compressing part 43 has a plurality of compression openings 47 opened along the up-down direction around the lower end portion of the separating body part main body 41, and a compression filter 48 that covers these compression openings 47. A portion of air turning between the outer circumference of the separating body part main body 41 and the inner circumference of the dust collecting cup 19 passes through the compression openings 47 (compression filter 48) from the lower end portion of the compressing part 43 via the inside of the compressing part 43, and accordingly presses dust centrifugally separated by the first centrifugally separating part 32 against the compression filter 48 to compress the dust inside the compressing part 43.

The communicating air passage part 35 is disposed along the up-down direction on the front side and the rear side of the electric blower chamber 26, and expands both leftward and rightward.

The second centrifugally separating parts 36 are positioned above the first centrifugally separating part 32, that is, in the present embodiment, higher than the upper end portion of the first centrifugally separating part 32, and centrifugally separate dust (fine dust) by turning air along the inner surfaces of the separating cylinder parts 37. Therefore, the turning flows in the second centrifugally separating parts 36 have axial directions along the up-down direction.

Each separating cylinder part 37 has an axial direction along the up-down direction at a position lateral to the communicating air passage part 35 (electric blower chamber 26), and is gradually decreased in diameter from the upper end portion toward the lower end portion. That is, these separating cylinder parts 37 (second centrifugally separating parts 36) have axial directions substantially parallel to the communicating air passage part 35 (electric blower 25). The diameter of each separating cylinder part 37 is set to be smaller than the diameter of the duct collecting cup 19. Therefore, the second centrifugally separating parts 36 are set so that the flow velocities of the turning flows in the second centrifugally separating parts 36 become higher than the flow velocity of the turning flow in the first centrifugally separating part 32. Further, each plurality, for example, three each of the separating cylinder parts 37 are disposed on the respective front and rear sides of the communicating air passage part 35 (electric blower 25), so that they are at substantially equal intervals along an arc that is along the circumferential direction of the communicating air passage part 35 (electric blower 25) as viewed from above. Therefore, each plurality (three) of these separating cylinder parts 37 (second centrifugally separating parts 36) are disposed on the respective positions opposite to each other with respect to the electric blower 25, positioned axisymmetric to each other in the front-rear direction about the central axis of the electric blower 25, and disposed radially around the central axis of the electric blower 25. Near the upper ends of the separating cylinder parts 37, suction opening parts 37*a* that communicate with the communicating air passage part 35 and guide air containing dust along the tangential direction into the separating cylinder parts 37 are opened in the sideward directions crossing the axial direction. Further, the lower end portions of the separating cylinder parts 37 serve as dust discharge ports 37*b* which are opened so as to face the upper portion of the dust collecting cup 19 and discharge dust to the dust collecting cup 19. On the upper end portions of the separating cylinder parts 37, cylindrical discharge cylinder parts 49 through which air from which dust was centrifugally separated reaches the air passage part 38 are disposed coaxially with the separating cylinder parts 37, and the upper end portions that are downstream ends of the discharge cylinder parts 49 serve as discharge opening parts 49*a* of the second centrifugally separating parts 36 through which air inside the separating cylinder parts 37 are discharged.

The air passage part 38 is positioned so as to extend in the front-rear direction along the upper portion of the inside of the case main body 21 of the main body case 18, and connected airtightly to the discharge opening parts 49*a* that are downstream ends of the discharge cylinder parts 49 respectively.

The holder receiving part 22 is positioned on the front side that is one lateral side lateral to the axial direction of a turning flow in the first centrifugally separating part 32, and projects from the front portion of the case main body 21. This holder receiving part 22 is formed into a tubular shape opened forward, and inside this holder receiving part 22, an engagement receiving portion (not shown) that detachably locks the airpassage body 13 to the main body part 12 is recessed.

The air passage body connecting part 23 is formed into a cylindrical shape whose axial direction is along the front-rear direction and the horizontal direction, and positioned below (just below) the holder receiving part 22 and on the front side that is one lateral side lateral to the axial directions of the turning flows in the second centrifugally separating parts 36 so as to project from the front portion of the case main body 21. That is, these holder receiving part 22 and air passage body connecting part 23 are respectively positioned on the front side that is the same lateral side of the main body part 12, and positioned one above the other when the main body part 12 (main body case 18) is viewed from the front side. This air passage body connecting part 23 is a part to be connected airtightly to the dust collecting cup 19, and inside this air passage body connecting part 23, a cylindrical sealing part 61 to airtightly connect the air passage body 13 and the dust collecting cup 19 to the passage body connecting part 23 is disposed.

The electric blower 25 generates a negative pressure by being driven by power supply from the secondary battery 27 to produce sucking wind for sucking dust into the dust collecting cup 19, and positioned at the substantially central portion in the front-rear direction and the left-right direction of the case main body 21 (main body case 18) so as to be higher than the first centrifugally separating part 32, and has an intake port 25*a* as the suction side positioned on the upper side and an exhaust port (not shown) as the exhaust side positioned on the lower side. That is, this electric blower 25 is disposed so as to have a component parallel to the axial direction (of the turning flow) in the first centrifugally separating part 32 (dust collecting cup 19), that is, an up-down component. In other words, this electric blower 25 is disposed along a direction different from the horizontal direction, and positioned so that its central axis (rotary axis) crosses the central axis (of the turning flow) of the first centrifugally separating part 32 (dust collecting cup 19) at an acute angle (preferably, an acute angle not more than 45 degrees) as viewed from the side, or coaxial with this central axis. That is, this electric blower 25 is disposed in series with the first centrifugally separating part 32 (dust collecting cup 19) in the up-down direction, and positioned on the extension of the central axis of the first centrifugally separating part 32 (dust collecting cup 19). The suction side (intake port 25*a*) of this electric blower 25 is positioned near the upper portion of the inside of the main body part 12 and communicates with the downstream sides of the second centrifugally separating parts 36 (via the air passage part 38), and communicates with the first centrifugally separating part 32 (dust collecting cup 19) via these air passage part 38, second centrifugally separating parts 36, and communicating air passage part 35.

The electric blower chamber 26 is formed into a substantially cylindrical shape, and positioned at the substantially central portion in the front-rear direction and the left-right direction of the main body case 18 of the main body part 12, and three each of the separating cylinder parts 37 are disposed at the respective front and rear sides of the electric blower chamber 26 via the communicating air passage part 35. In other words, the communicating air passage part 35 is positioned between the electric blower chamber 26 (electric blower 25) and the separating cylinder parts 37. At the central portion of the lower portion of the electric blower chamber 26, a discharge opening 65 that communicates with the exhaust side (exhaust port) of the electric blower 25 is opened downward. That is, this discharge opening 65 is positioned at the lower portion of the main body case 18 of the main body part 12, and communicates with the inside of the separating body part 33.

The main body control part includes, for example, a microcomputer, etc., and can operate and stop the electric blower 25 in a predetermined operation mode by controlling the conduction angle of the electric blower 25.

The secondary battery 27 supplies power to the electric blower 25, the main body control part, and the air passage body 13 side, etc., and is connectable to an external charging circuit via a terminal (not shown), and chargeable via this charging circuit as necessary. This secondary battery 27 is housed along the up-down direction at the position of the rear end portion of the case main body 21 (main body case 18), that is, a position on the rear side that is the other lateral side lateral to the axial directions of the turning flows in the first and second centrifugally separating parts 32 and 36. In other words, the holder receiving part 22 and the air passage body connecting part 23, and the secondary battery 27 are positioned on the sides opposite to each other of the main body part 12 via the first and second centrifugally separating parts 32 and 36 (dust collecting cup 19).

The dust collecting cup 19 is a part that collects dust sucked by driving of the electric blower 25, and includes a dust collecting cup main body 66 that is a storage part as a first dust storage part having a bottomed cylindrical shape, an introduction part 67 projecting from the front portion of the dust collecting cup main body 66, and a fine dust receiving part 68 as a second dust storage part provided integrally with the upper portion of the dust collecting cup main body 66. To the rear portion of the dust collecting cup main body 66 of the dust collecting cup 19, a clamp 70 as a holding unit that detachably locks and holds the dust collecting cup 19 to the main body case 18 (attaching opening part 31) is attached.

The dust collecting cup main body 66 is molded integrally with, for example, the introduction part 67 and the fine dust receiving part 68 by using a member such as a (transparent) synthetic resin with translucency. This dust collecting cup main body 66 is a part to be positioned around the separating body part 33 in the state where the dust collecting cup 19 is attached to the main body case 18 (attaching opening part 31). That is, this dust collecting cup main body 66 constitutes the first centrifugally separating part 32 together with the separating body part 33, and the lower portion of the dust collecting cup main body serves as a dust storing part 71 that stores dust centrifugally separated by the first centrifugally separating part 32. This dust collecting cup main body 66 has a diameter set to be larger than the diameters of the respective separating cylinder parts 37. An exhaust tube part 74 as a discharge part is formed integrally with the bottom portion of the dust collecting cup main body 66 so as to become coaxial (concentric) with the dust collecting cup main body 66, that is, along the central axis of the dust collecting cup main body 66, and from the outer surface portion of this bottom portion, a plurality of ribs 75 as air guide parts project along radial directions respectively.

The exhaust tube part 74 is a part through which exhaust air of the electric blower 25 is discharged to the outside of the main body part 12, and is inserted into the insides of the compressing part 43 and the separating body part main body 41 of the separating body part 33 and connected coaxially airtightly to the lower end portion of the exhaust part 42 and connected airtightly to the discharge opening 65 on the lower portion of the electric blower chamber 26 via this exhaust part 42 in the state where the dust collecting cup 19 is attached to the main body case 18 (attaching opening part 31). That is, this exhaust tube part 74 is connected airtightly to the exhaust side (exhaust port) of the electric blower 25. In other words, the discharge opening 65 communicating with the exhaust side (exhaust port) of the electric blower 25 is connected airtightly to the upstream side of the exhaust tube part 74 (via the exhaust part 42). Therefore, the outsides of the exhaust part 42 and the exhaust tube part 74 communicate with the suction side of the electric blower 25, and the insides of the exhaust part 42 and the exhaust tube part 74 communicate with the exhaust side of the electric blower 25 so that these suction side and the exhaust side are partitioned from each other as separate chambers. The lower end portion that is the downstream end of the exhaust tube part 74 serves as an exhaust opening part 76 through which exhaust air of the electric blower 25 is discharged to the outside of the main body part 12.

The introduction part 67 introduces air containing dust into the dust collecting cup main body 66 at a position near the upper end of the dust collecting cup main body 66, that is, a position facing the front side of the separating body part main body 41 (separating filter 45) of the separating body part 33 inserted into the dust collecting cup main body 66 (dust collecting cup 19), and the front end portion that is the upstream end portion thereof is connected airtightly to the downstream side of the air passage body connecting part 23 via the sealing part 61 in the state where the dust collecting cup 19 is attached to the main body case 18 (attaching opening part 31). At the rear end portion that is the downstream end of the introduction part 67, a suction port 77 for introducing air containing dust into the dust collecting cup main body 66 (dust collecting cup 19) is opened along the tangential direction of the dust collecting cup main body 66. This suction port 77 is disposed at substantially the same height as that of the separating body part 33 in the up-down direction, that is, the axial direction of the turning flow in the first centrifugally separating part 32. Therefore, this suction port 77 is positioned so as to be lower than the electric blower 25 and deviates (in the up-down direction) from the intake port 25*a* and the exhaust port of the electric blower 25.

The fine dust receiving part 68 communicates with the lower portions of the lower end portions of the second centrifugally separating parts 36 (separating cylinder parts 37) in the state where the dust collecting cup 19 is attached to the main body case 18 (attaching opening part 31), and stores dust centrifugally separated by the second centrifugally separating parts 36. This fine dust receiving part 68 extends along the front-rear direction crossing (orthogonal to) the axial direction of the dust collecting cup main body 66 at a position near the upper end portion of the dust collecting cup main body 66, and is curved into a tray shape opened upward as viewed from the front-rear direction.

The clamp 70 is disposed to assume a substantially L shape from the upper end of the rear portion of the dust collecting cup main body 66 to the lower portion of the rear portion of the fine dust receiving part 68.

On the other hand, the air passage body 13 includes a stretchable hose body 82 whose rear side that is the downstream side is communicatively connected to the front side that is the upstream side of the air passage body connecting part 23, a suction port body part 83 to which the front side that is the upstream side of the hose body 82 is communicatively connected, and an attachment part 84 that is detachably communicatively connected to the front side that is the upstream side of the suction port body part 83. This air passage body 13 can be selectively used in a state where the air passage body is held by the holder part 14 with respect to the main body part 12 and a state where the air passage body is detached from the main body part 12 at the position of the holder part 14 according to a manner of cleaning.

One end side that is the downstream end side, that is, the rear end side of the hose body 82 is connected airtightly to the main body part 12 (air passage body connecting part 23 (sealing part 61)), and the other end side that is the upstream end side, that is, the front end side is held by the holder part 14 and connected airtightly to the suction port body part 83 (attachment part 84). Therefore, the downstream end side of this hose body 82 communicates with the dust collecting cup 19 (first centrifugally separating part 32) via the air passage body connecting part 23, and further communicates with the suction side of the electric blower 25 via the dust collecting cup 19, the communicating air passage part 35, the separating cylinder parts 37 (second centrifugally separating parts 36), and the air passage part 38. This hose body 82 is formed into a bellows shape from, for example, a synthetic resin, etc., with flexibility, to be stretchable, and biased toward the contracting direction. That is, this hose body 82 is maximally contracted in its natural state (no-load state), and is formed so that concavities and convexities on the inner surface adhere to each other to become flat in this maximally contracted state. In other words, this hose body 82 is stretched only when it is kept in a state where the hose body is pulled toward both ends by an external force (a state where the upstream side is pulled with respect to the downstream side fixed to the main body part 12 side).

The suction port body part 83 is provided on the front end portion that is the upstream end portion of the hose body 82. This suction port body part 83 includes a cylindrical suction port body part main body 85, a cylindrical connecting part 86 that communicates with the suction port body part main body 85 and projects from the lower side of the rear portion of the suction port body part main body 85, a brush part 87 as a cleaning part disposed rotatably on the front end portion that is the upstream end portion of the suction port body part main body 85, and a holding clamp 89 that detachably locks and holds the attachment part 84 to the suction port body part 83.

The suction port body part main body 85 is formed into a straight tubular shape from a synthetic resin, etc., that is a member harder than the hose body 82, and provided so that its rear end portion that is the downstream end portion becomes integral with the holder part 14.

The connecting part 86 assumes a straight tubular shape whose axial direction inclines along a direction crossing at an acute angle the axial direction of the suction port body part main body 85, and is provided integrally with the suction port body part main body 85, and into the connecting part 86, the upstream side end portion of the hose body 82 is inserted and connected airtightly.

The brush part 87 is formed into an annular shape having a plurality of brush bristles 87*a* as cleaning members on the front end portion, and both sides of the inner edge are axially supported rotatably by both side portions of the front end portion that is the upstream end portion of the suction port body part main body 85 so that the brush part 87 becomes rotatable in the up-down direction crossing the axial direction of the suction port body part main body 85.

The holding clamp 89 is partially exposed to the upper portion of the suction port body part main body 85 so as to become operable.

The attachment part 84 is attached to and detached from the suction port body part 83 as necessary according to a manner of cleaning, and includes, for example, an extension tube 91 that is a straight long tube, and a floor brush 92 as a suction port body attachable to and detachable from the front end that is the upstream end of the extension tube 91.

The extension tube 91 includes a connecting port part 96 on the rear end portion that is the downstream end portion, and a suction port part 97 on the front end portion that is the upstream end portion. The connecting port part 96 is a portion to be inserted into the front end portion of the suction port body part 83 when the attachment part 84 (extension tube 91) is connected to the suction port body part 83. The suction port part 97 includes a cylindrical suction port part main body 101, a brush bristle part 102 as a cleaning body part disposed rotatably on the front end portion that is the upstream end portion of the suction port part main body 101, and a clamp part 104 that detachably locks and holds the floor brush 92 to the suction port part 97.

The brush bristle part 102 is formed into an annular shape having a plurality of brush bristles 102*a* as extension tube cleaning members on the front end portion, and both sides of the inner edge of the brush bristle part 102 are axially supported rotatably on both side portions of the front end portion that is the upstream end portion of the suction port part main body 101 and rotatable in the up-down direction crossing the axial direction of the suction port part main body 101.

The clamp part 104 is partially exposed to the upper portion of the suction port part main body 101 so as to become operable.

The floor brush 92 includes a case body 106 longitudinal along the left-right width direction, that is, horizontally long, and a rotary tube 107 connected rotatably to the rear portion of the case body 106.

In the case body 106, a suction port (not shown) is opened in the lower surface facing a surface to be cleaned. In this suction port, a rotary brush as a rotary cleaning body may be disposed.

The rotary tube 107 is axially supported rotatably at least around the axis with respect to the case body 106, and communicates with the suction port. The rear end side (downstream end side) of this rotary tube 107 has dimensions substantially equal to those of the downstream end side of the extension tube 91, and are attachable to and detachable from the suction port body part 83 as well as the suction port part 97.

The holder part 14 makes a position different from the downstream end portion of the hose body 82 that is the downstream end side of the air passage body 13, that is, in the present embodiment, the suction port body part 83 on the upstream side of the hose body 82 attachable to and detachable from the main body part 12 (holder receiving part 22), and consists of an air passage body handle 17 that is provided integrally with the suction port body part main body 85 of the suction port body part 83 and branched in parallel to the hose body 82, a joint part 117 positioned on the rear end portion of the air passage body handle 17, and a clamp body 118 as a lock means provided on the air passage body handle 17. That is, the air passage body handle 17 constitutes a portion of the holder part 14. In other words, the holder part 14 also serves as the air passage body handle 17, and a position different from the hose body 82 that is on the downstream side of the air passage body 13, that is, in the present embodiment, the front end portion of holder part 14 is integrally provided with the suction port body part 83 on the further upstream side than that of the hose body 82. By this holder part 14, the air passage body 13 is made attachable to and detachable from the main body part 12 at a position higher than the hose body 82.

The air passage body handle 17 is for gripping the air passage body 13 detached from the main body part 12 at the position of the holder part 14, and is made of a member such as a synthetic resin harder than the hose body 82, formed coaxially with the suction port body part main body 85 and aligned with the suction port body part main body 85 on a substantially straight line, and projects more rearward than the suction port body part main body 85 and extends to be longitudinal along the front-rear direction.

The joint part 117 is a part that continues to the rear end portion of the air passage body handle 17 (locates at the rear end side that is one end side of the holder part 14) and fits the holder receiving part 22 of the main body part 12, and includes a cylindrical connecting projection part 122 projecting rearward. This connecting projection part 122 is a part that is inserted and fitted into the holder receiving part 22 when the air passage body 13 is attached to the main body part 12 by the holder part 14.

The clamp body 118 is partially exposed to the upper portion of the front side of the air passage body handle 17 so as to become slidable along, for example, the front-rear direction, and a claw part (not shown) to be latched into an engagement receiving portion of the holder receiving part 22 is exposed to the upper portion of the connecting projection part 122.

The main body handle 15 is looped in the up-down direction so as to open in the left-right direction crossing (orthogonal to) the longitudinal direction of the main body part 12 between the main body handle 15 and the rear portion of the main body part 12. That is, this main body handle 15 is formed along the up-down direction. On the upper portion of the main body handle 15, a plurality of setting buttons 135 to be used by a user to perform setting operations, etc., of the electric blower 25 by a hand gripping the main body handle 15 are disposed so as to be separated from each other in the front-rear direction.

Next, operation of the first embodiment described above is described.

Figure 4:
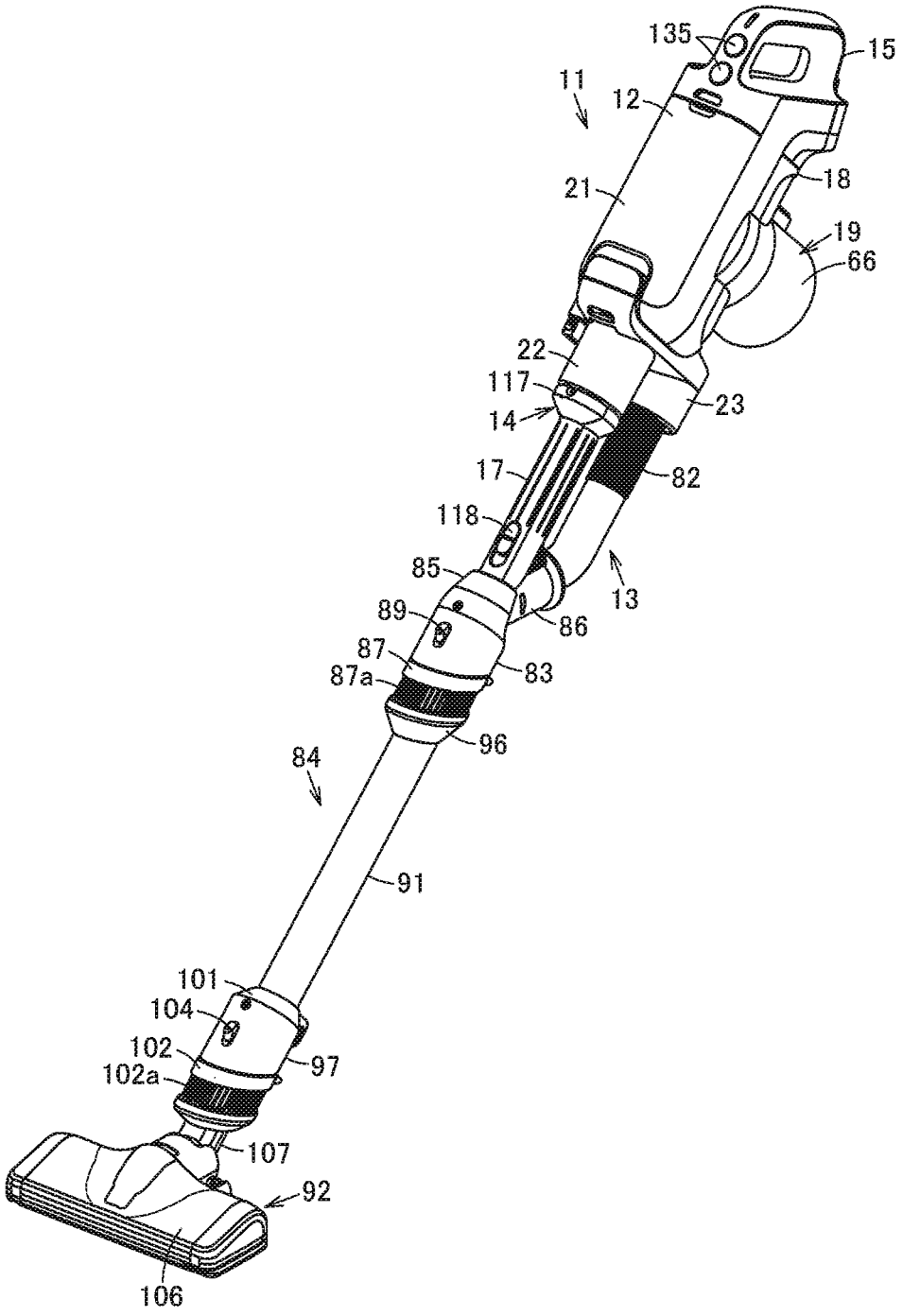
FIG. 4 is a perspective view showing a usage state of the same electric vacuum cleaner where the air passage body is attached to the main body part by the holder part.
Figure 5:
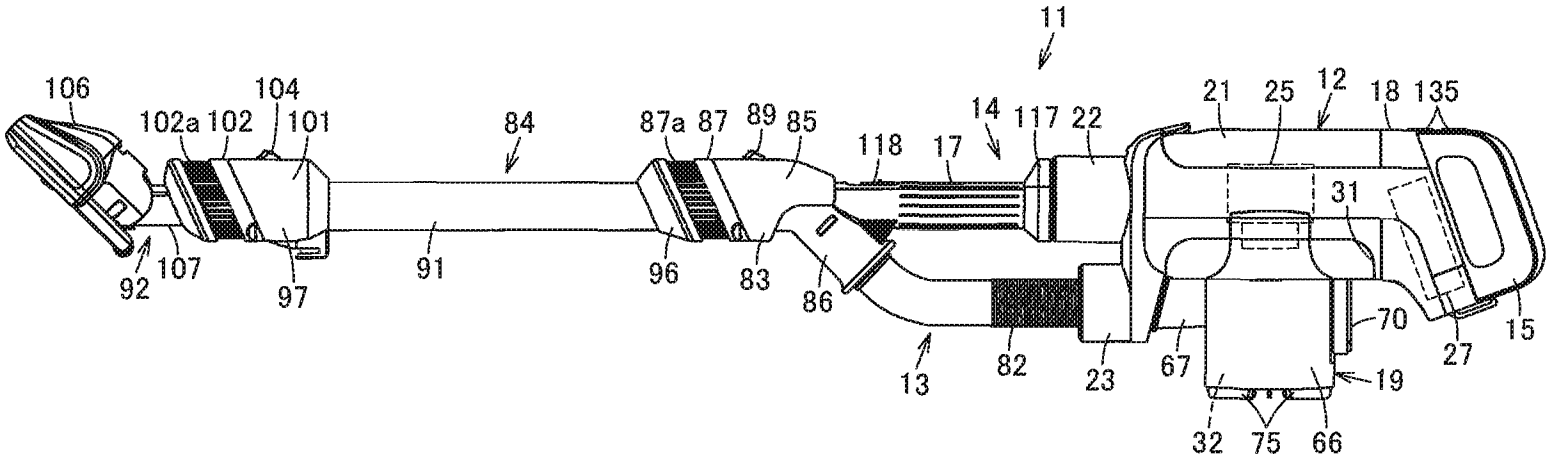
FIG. 5 is a side view showing a usage state of the same electric vacuum cleaner.

For example, in the case where the electric vacuum cleaner 11 cleans a surface to be cleaned of a comparatively wide area such as an indoor floor surface, as shown in FIG. 4 and FIG. 5, the air passage body 13 is attached to the main body part 12 by the holder part 14 at the position of the holder receiving part 22, and cleaning is performed while the entire electric vacuum cleaner 11 is moved by gripping the main body handle 15.

At this time, the dust collecting cup 19 is attached to the main body case 18 in advance. That is, by aligning the dust collecting cup 19 with the attaching opening part 31 of the main body case 18 and pushing the dust collecting cup 19 into the main body case 18 side, the fine dust receiving part 68 faces the lower end portions of the second centrifugally separating parts 36 (separating cylinder parts 37) and communicates with the dust discharge ports 37*b*, and the separating body part 33 is inserted coaxially into the dust collecting cup main body 66, the exhaust tube part 74 is inserted into the separating body part 33, connected airtightly to the exhaust part 42, and connected airtightly to the discharge opening 65 via the exhaust part 42, and in the state where the front end portion that is the upstream end portion of the introduction part 67 is connected airtightly to the rear end portion that is the downstream side of the air passage body connecting part 23 (air passage body 13) via the sealing part 61, the dust collecting cup 19 is locked and held to the main body case 18 by the operation of the clamp 70.

Into the front end portion that is the upstream end portion of the suction port body part 83 of the air passage body 13, the connecting port part 96 of the extension tube 91 is inserted and connected, and into the front end portion that is the upstream end portion of the suction port part 97 of the extension tube 91, the rotary tube 107 of the floor brush 92 is inserted and connected. At this time, the extension tube 91 is locked and held while being connected airtightly to the suction port body part 83 by the operation of the holding clamp 89, and the floor brush 92 is locked and held while being connected airtightly to the extension tube 91 by the operation of the clamp part 104.

Further, in the holder part 14, by inserting and fitting the joint part 117 of the rear end portion of the air passage body handle 17 shown in FIG. 2 to the holder receiving part 22 of the main body part 12 from the front side while they are aligned with each other, the connecting projection part 122 is inserted relatively into the holder receiving part 22, and the claw part of the clamp body 118 is inserted and latched into the engagement receiving portion, and accordingly, the air passage body 13 is held on the main body part 12 at the position of the holder part 14. In this state, as shown in FIG. 4 and FIG. 5, the air passage body handle 17 constituting a portion of the holder part 14 is positioned along the front-rear direction, and the suction port body part 83 coaxial with the air passage body handle 17 is positioned so as to assume a straight tubular shape along the front-rear direction, and accordingly, the air passage body 13 reaches a state where the floor brush 92, the extension tube 91 (attachment part 84), the suction port body part 83, and the air passage body handle 17 are positioned on a substantially straight line, and the downstream end side of the hose body 82 branching downward from the suction port body part 83 is connected to the main body part 12 by the air passage body connecting part 23 positioned lower than the holder part 14. As a result, by the holder part 14, the shape of the hose body 82 is kept from the upstream side to the downstream side in a state where it is gently curved from the upper side to the lower side, and the air passage body 13 communicates substantially straight with the first centrifugally separating part 32 basically along the front-rear direction without sharply curving upward, downward, leftward, or rightward. Therefore, pressure loss inside the air passage body 13 is small, and air and dust easily pass through the inside of the air passage body 13. That is, the air passage body 13 is mechanically connected to the main body part 12 at the position of the holder part 14 and the position on the downstream end side of the hose body 82, in other words, at the positions arranged vertically, and communicates as an air passage with the main body part 12 at the position on the downstream end side of the hose body 82.

A user drives the electric blower 25 in a desired operation mode via the main body control part by operating the setting buttons 135 while gripping the main body handle 15. A negative pressure generated by driving of the electric blower 25 is applied to the suction port of the floor brush 92 via the air passage part 38, the second centrifugally separating parts 36, the communicating air passage part 35, the first centrifugally separating part 32, the introduction part 67, the air passage body connecting part 23 (sealing part 61), the hose body 82, the suction port body part 83, and the attachment part 84, so that dust is sucked together with air from the suction port by the action of the negative pressure of the electric blower 25 on a surface to be cleaned while the user makes the floor brush 92 placed on the surface to be cleaned travel alternately forward and backward on a surface to be cleaned together with the entire electric vacuum cleaner 11. The user also performs a cleaning assisting operation such as scraping-off dust from the surface to be cleaned or polishing the surface to be cleaned by rotationally driving the rotary brush of the floor brush 92 as necessary.

At this time, air sucked together with dust, that is, air containing dust moves to the floor brush 92, the extension tube 91, the suction port body part 83, and the hose body 82, and is sucked into the dust collecting cup 19 (dust collecting cup main body 66) of the first centrifugally separating part 32 along the tangential direction from the downstream end of the hose body 82 via the air passage body connecting part 23 (sealing part 61), the introduction part 67, and the suction port 77 while gently curving along the inner surface of the hose body 82.

Figure 6:
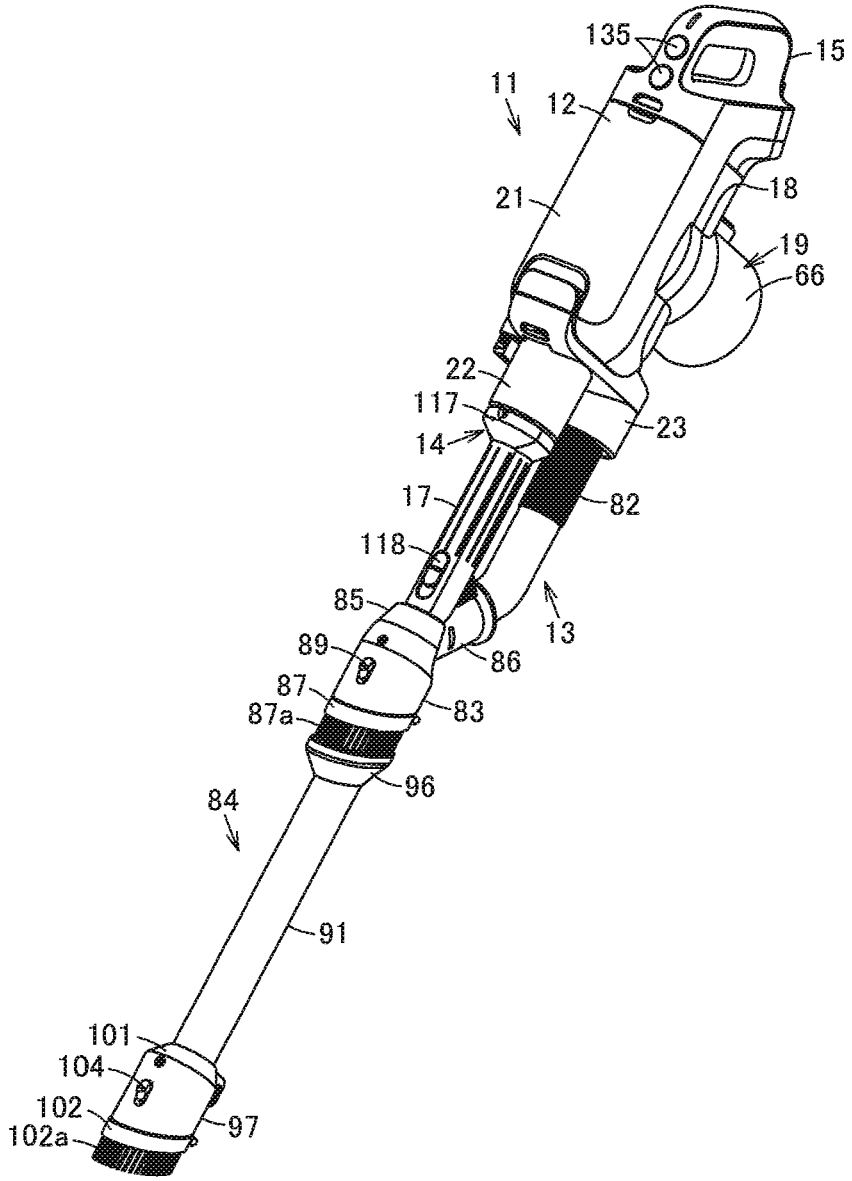
FIG. 6 is a perspective view showing another usage state of the same electric vacuum cleaner where the air passage body is attached to the main body part by the holder part.

According to the necessity of cleaning a narrow space into which the floor brush 92 cannot be inserted, for example, a space between furniture and a wall portion, the electric vacuum cleaner 11 can also be used in the state where the floor brush 92 is detached from the extension tube 91 (FIG. 6). In this case, by operating the holding clamp 89, the floor brush 92 is unlocked and detached from the extension tube 91. Then, the user performs cleaning of the surface to be cleaned by making the electric vacuum cleaner 11 suck dust together with air from the suction port part 97 in the same manner as described above while using the brush bristle part 102 of the suction port part 97 on the front end portion of the extension tube 91, etc.

Figure 7:
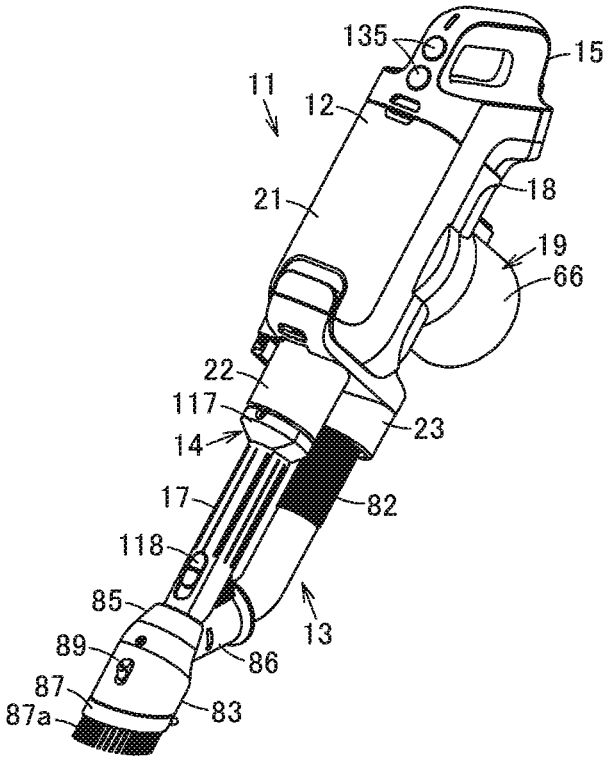
FIG. 7 is a perspective view showing still another usage state of the same electric vacuum cleaner where the air passage body is attached to the main body part by the holder part.

On the other hand, in the case of cleaning of the surface of a table and a surface to be cleaned of a comparatively narrow area, etc., from the state shown in FIG. 4 to FIG. 6, as shown in FIG. 7, the attachment part 84 (extension tube 91 and floor brush 92) is detached in the air passage body 13, and cleaning is performed while the entire electric vacuum cleaner 11 is moved by gripping the main body handle 15.

At this time, the attachment part 84 (extension tube 91) is detached from the suction port body part 83 by operating the holding clamp 89. Then, the user performs cleaning with the brush part 87, etc., of the suction port body part 83 by making the electric vacuum cleaner 11 suck dust together with air from the suction port body part 83 while carrying the entire electric vacuum cleaner 11 by gripping the main body handle 15.

Figure 8:
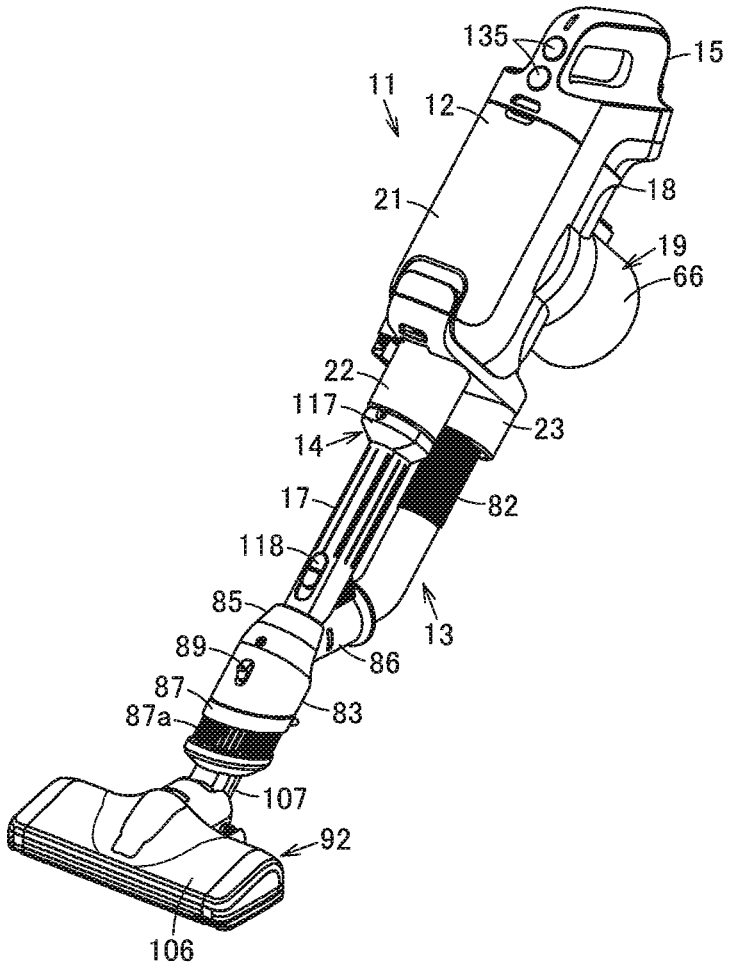
FIG. 8 is a perspective view showing still another usage state of the same electric vacuum cleaner where the air passage body is attached to the main body part by the holder part.

At this time, according to the necessity of the kind of the surface to be cleaned, etc., the electric vacuum cleaner 11 can also be used in the state where only the floor brush 92 is attached to the suction port body part 83 (FIG. 8). In this case, by inserting the rotary tube 107 of the floor brush 92 into the suction port body part 83 from the upstream side, the floor brush 92 is held in the state where it is connected airtightly to the suction port body part 83 by the operation of the holding clamp 89. Then, while making the floor brush 92 placed on the surface to be cleaned travel alternately forward and backward on the surface to be cleaned together with the entire electric vacuum cleaner 11, the user makes the electric vacuum cleaner 11 suck dust together with air from the suction port by the action of the negative pressure of the electric blower 25 on the surface to be cleaned. The user also performs a cleaning assisting operation such as scraping-off dust from the surface to be cleaned or polishing the surface to be cleaned by rotationally driving the rotary brush of the floor brush 92 as necessary.

Further, in the case of cleaning at a relatively high position, for example, a ceiling, etc., from the state shown in FIG. 6, as shown in FIG. 2, the air passage body 13 is detached from the main body part 12 by the holder part 14, and while the main body part 12 is carried and the hose body 82 of the air passage body 13 is stretched (expanded and contracted) with respect to the main body part 12, cleaning is performed with the suction port part 97 on the front end portion of the extension tube 91.

In the case of cleaning at a position near the hand of a user, for example, a position behind an installed object such as a television, a vehicle seat, and stairs, etc., as shown in FIG. 3, the extension tube 91 is detached from the state shown in FIG. 2, and while the main body part 12 is carried and the hose body 82 of the air passage body 13 is stretched (expanded and contracted) with respect to the main body part 12, cleaning is performed with the suction port body part 83.

In the case of these cleaning manners shown in FIG. 2 and FIG. 3, by operating the clamp body 118, in the state where the claw part of the clamp body 118 is pulled out from the engagement receiving portion of the holder receiving part 22, the air passage body 13 is moved forward with respect to the main body part 12, and accordingly, in the holder part 14, the joint part 117 on the rear end portion of the air passage body handle 17 is separated from the holder receiving part 22 of the main body part 12, and the connecting projection part 122 is pulled out from the holder receiving part 22.

Then, while the main body part 12 is lifted by gripping the main body handle 15 by one hand of a user, the air passage body handle 17 is gripped by the other hand, and basically, while only the air passage body 13 is moved by expanding and contracting the hose body 82, cleaning is performed by sucking dust together with air by using the brush bristle part 102 of the suction port part 97 or the brush part 87 of the suction port body part 83.

In the case of cleaning of a range which can be reached by only stretching the hose body 82, or in the case of cleaning at a position below a bed, etc., the main body part 12 may be placed on the surface to be cleaned without being lifted by gripping the main body handle 15. At this time, by the contact of the ribs 75 with the surface to be cleaned, the exhaust opening part 76 on the lower portion of the dust collecting cup 19 is separated from the surface to be cleaned and is not closed by the surface to be cleaned, so that exhaust from the exhaust tube part 74 (exhaust opening part 76) is not obstructed.

Then, air containing dust sucked into the dust collecting cup 19 (dust collecting cup main body 66) of the first centrifugally separating part 32 is turned between the inner circumferential surface of the dust collecting cup 19 (dust collecting cup main body 66) and the outer circumferential surface of the separating body part main body 41 of the separating body part 33 and extremely large dust (coarse dust) is centrifugally separated due to its own weight from the air, and falls along the inner circumferential surface of the dust collecting cup main body 66 and is collected in the dust storing part 71 of the dust collecting cup main body 66. This dust is pressed against the compression filter 48 and compressed according to passing of a portion of the turning flow inside the dust collecting cup main body 66 through the compression openings 47 (compression filter 48) from the lower end portion of the compressing part 43, and is stored inside the compressing part 43.

Air from which dust was centrifugally separated flows into the openings 44 while passing through the separating filter 45. This air that passed through the openings 44 (separating filter 45) passes through the communicating air passage part 35 while being straightened by the smooth cylindrical outer circumference of the exhaust part 42. Further, this air that passed through the communicating air passage part 35 flows into the second centrifugally separating parts 36 (separating cylinder parts 37) via the suction opening parts 37*a*, and is turned along the inner circumferential surfaces of the separating cylinder parts 37 in the second centrifugally separating parts 36, and fine dust is further centrifugally separated. This separated fine dust falls from the dust discharge ports 37*b* of the lower end portions of the separating cylinder parts 37 to the fine dust receiving part 68 of the dust collecting cup 19 and is collected therein. That is, coarse dust and fine dust are separately collected in the dust collecting cup main body 66 and the fine dust receiving part 68. The air from which the fine dust was separated flows into the air passage part 38 from the discharge opening parts 49*a* of the discharge cylinder parts 49 on the upper end portion of the separating cylinder parts 37 and is sucked into the intake port 25*a* of the electric blower 25 via the air passage part 38.

Then, the air sucked into the electric blower 25 passes through the electric blower 25 while cooling it and becomes exhaust wind, and is discharged from the exhaust port to the inside of the electric blower chamber 26, and then passes through the inside of the separating body part 33 downward from the discharge opening 65 on the lower portion of the electric blower chamber 26 while being straightened by the smooth inner circumferential surfaces of the exhaust part 42 and the exhaust tube part 74, and is discharged downward, that is, to the outside of the dust collecting cup 19 (main body part 12) from the exhaust opening part 76.

When cleaning is finished, the user stops the electric blower 25 by operating the setting buttons 135.

To dispose of dust, the clamp 70 is operated to detach the dust collecting cup 19 from the main body case 18 (attaching opening part 31), and the dust collecting cup 19 is turned upside down over a trash box, etc., to discharge the dust from the dust storing part 71 and the fine dust receiving part 68.

According to the first embodiment described above, in the dust collecting cup 19 of the first centrifugally separating part 32 that centrifugally separates dust from air containing dust sucked by the electric blower 25, by providing an exhaust tube part 74 through which exhaust air of the electric blower 25 is discharged from the bottom portion (exhaust opening part 76) along the central axis of the dust collecting cup main body 66 that turns air containing dust, without increasing the size of the main body part 12 more than required, an exhaust air passage through which exhaust air from the electric blower 25 can be discharged with little resistance while being straightened can be formed by the exhaust tube part 74 by effectively using the space around the central axis of the first centrifugally separating part 32. Therefore, the efficiency can be improved, and the sound pressure of noise such as wind noise caused by driving of the electric blower 25 can also be attenuated by the exhaust tube part 74 due to discharge of the exhaust air via the exhaust tube part 74, so that quietness can be secured.

In addition, exhaust air of the electric blower 25 is discharged via the exhaust tube part 74 positioned at the center of so-called cold air turning inside the dust collecting cup main body 66 before being sucked by the electric blower 25, so that exhaust air that is so-called hot air after passing through the electric blower 25 is cooled by the air turning inside the dust collecting cup main body 66. Therefore, even if the exhaust air blows against the body of a user, it is not lukewarm exhaust air, so that it hardly deteriorates the user's feeling of use.

In addition, the exhaust tube part 74 is formed to be cylindrical, so that exhaust air that passes through the inside of the exhaust tube part 74 from the electric blower 25 can be straightened by the smooth inner circumferential surface of the exhaust tube part 74, occurrence of turbulence can be suppressed and the efficiency can be improved, and noise, etc., to be caused by the turbulence can also be suppressed, so that the quietness can be improved.

Further, the separating body part 33 that turns air containing dust around it and makes the air pass inward from the openings 44 is disposed along the central axis of the dust collecting cup main body 66 of the first centrifugally separating part 32, and at least a portion of the cylindrical exhaust part 42 that communicates with the upstream side of the exhaust tube part 74 is disposed inside the separating body part 33, and accordingly, the exhaust part 42 can be compactly disposed, and air that passed inward through the separating body part 33 flows into the communicating air passage part 35 while being straightened by the smooth outer circumferential surface of the cylindrical exhaust part 42, so that air passage resistance becomes smaller and the efficiency can be improved.

In addition, by disposing the electric blower 25 so that its central axis has a component parallel to the central axis of the first centrifugally separating part 32, that is, in the present embodiment, the central axis of the electric blower 25 and the central axis of the first centrifugally separating part 32 are in series, exhaust air discharged from the exhaust port of the electric blower 25 can be made to directly pass straight through the exhaust tube part 74 (exhaust part 42) along the axial direction of the electric blower 25, so that the efficiency can be improved.

In the first centrifugally separating part 32, for centrifugal separation of coarse dust, the diameter of the dust collecting cup main body 66 is set to be comparatively large. Therefore, by providing the suction port 77 of this first centrifugally separating part 32 at a position deviating from the suction side (intake port 25*a*) of the electric blower 25, that is, by disposing the first centrifugally separating part 32 and the electric blower 25 in the axial direction (up-down direction) without making these close to each other, the main body part 12 can be made smaller in size than, for example, the case where the first centrifugally separating part is disposed lateral to the electric blower.

Further, the suction port 77 of the first centrifugally separating part 32 is at the position lateral to the separating body part 33, so that so-called cold air containing dust sucked from this suction port 77 easily strikes the exhaust part 42 inside the separating body part 33 via the openings 44, so that exhaust air passing through the exhaust part 42 and the exhaust tube part 74 can be more efficiently cooled.

By providing, lateral to the electric blower 25, the second centrifugally separating parts 36 that have central axes substantially parallel to the central axis of the electric blower 25, communicate with the downstream side of the first centrifugally separating part 32, and centrifugally separate dust smaller than dust to be separated by the first centrifugally separating part 32, noise leaking in radial directions from the electric blower 25 (electric blower chamber 26) is cut by the second centrifugally separating parts 36. That is, the outer circumferential portions of the separating cylinder parts 37 constituting the second centrifugally separating parts 36 serve as sound insulation walls, so that the quietness can be further improved. Further, the separating cylinder parts 37 of the second centrifugally separating parts 36 have diameters set to be comparatively small so as to increase the flow velocities to centrifugally separate dust smaller than dust to be separated by the first centrifugally separating part 32, so that even when the second centrifugally separating parts 36 are disposed lateral to the electric blower 25 (electric blower chamber 26), the main body part 12 is hardly increased in size, and the outer circumferential portions of the separating cylinder parts 37 of the second centrifugally separating parts 36 double-cut noise by the portions facing the electric blower 25 (electric blower chamber 26) and the portions on the opposite side. That is, noise leaking in radial directions from the electric blower 25 (electric blower chamber 26) is multi-cut by the outer circumferential portions of the separating cylinder parts 37. As a result, the quietness can be more reliably improved.

Moreover, a plurality of second centrifugally separating parts 36 are disposed on at least a portion of the periphery of the electric blower 25, that is, in the present embodiment, on the front side and the rear side of the electric blower 25, so that the front side and the rear side of the electric blower 25 are surrounded by the plurality of second centrifugally separating parts 36. Therefore, the outer circumferential portions of the separating cylinder parts 37 of the second centrifugally separating parts 36 reliably cut noise leaking from the electric blower 25, and can reliably improve the quietness.

In the lower portion of the main body part 12, by providing a discharge opening 65 that communicates with the downstream side of the electric blower 25 and the upstream side of the exhaust tube part 74 of the first centrifugally separating part 32 (via the exhaust part 42), exhaust air is blown downward of the main body part 12 via the exhaust tube part 74. Therefore, on the front side of the main body part 12, the air passage body 13 that communicates with the first centrifugally separating part 32 and guides air containing dust to the first centrifugally separating part 32 is provided, and the main body handle 15 is provided on the upper portion of the main body part 12, so that regardless of which of the right and left hand a user's dominant hand is, the exhaust wind of the exhaust tube part 74 hardly blows against the user's hand gripping the main body handle 15 or the air passage body 13 (air passage body handle 17) and the user's body, and therefore, the feeling of use can be improved.

In the first embodiment described above, the exhaust part 42 may be provided integrally with, for example, the exhaust tube part 74 or the electric blower chamber 26. That is, the exhaust part 42 may be constituted so that its lower end portion serves as the discharge opening 65.

The main body handle 15 is provided on the rear portion of the main body part 12, however, it may be provided on the upper portion of the main body part 12, for example, above (just above) the center of gravity of the main body part 12, and may be provided on each of the upper and rear portions of the main body part 12.

Next, a second embodiment is described with reference to FIG. 9 to FIG. 17. The same constitutions and operations as in the first embodiment described above are designated by the same reference symbols, and description thereof is omitted.

In this second embodiment, the dust collecting cup 19 according to the first embodiment includes a cover 141 that covers the lower end portion of the dust collecting cup main body 66.

Figure 16:
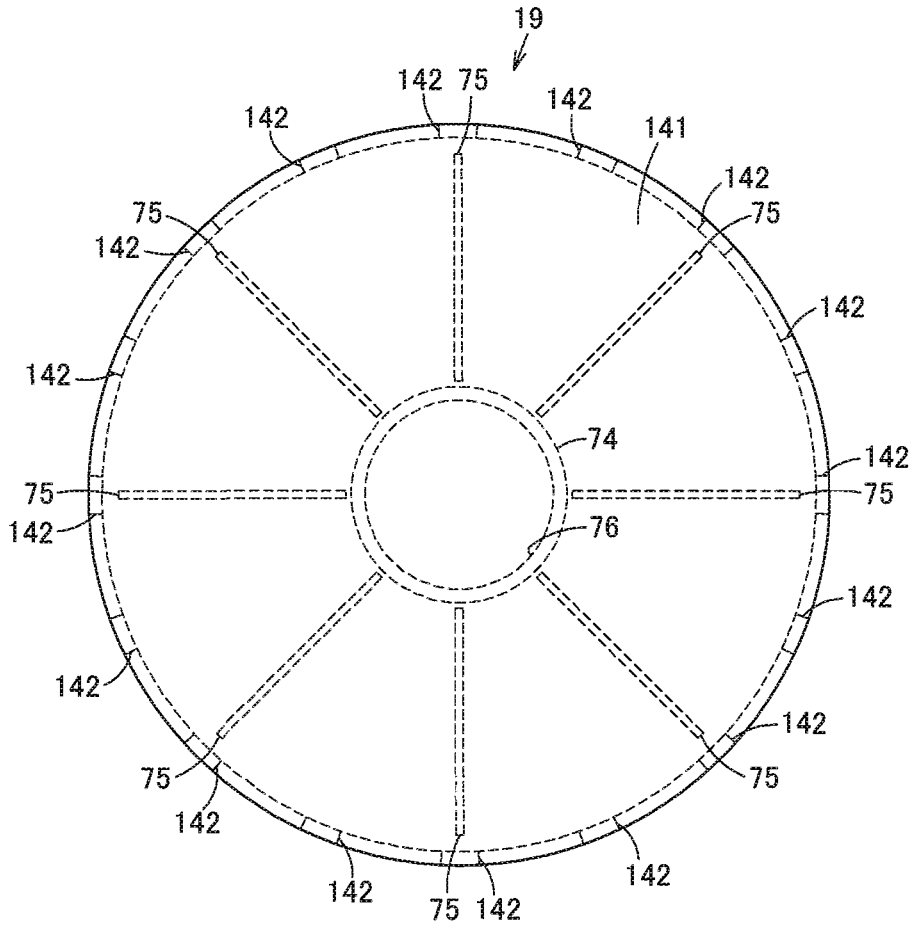
FIG. 16 is a plan view schematically showing an upstream side separating part of the same electric vacuum cleaner from below.
Figure 17:
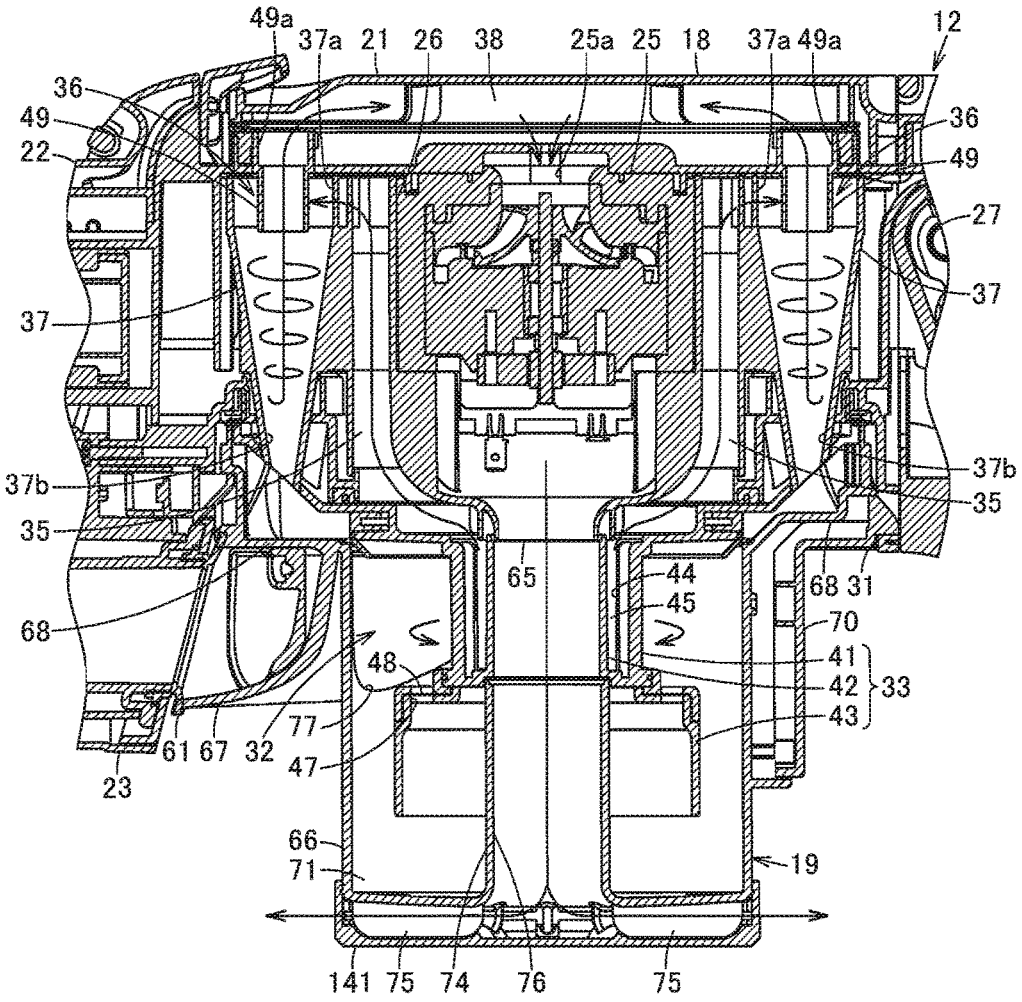
FIG. 17 is a sectional view showing a portion of the main body part of the same electric vacuum cleaner.

The cover 141 is formed from a soft member that is a soft synthetic resin, for example, elastomer or the like into a bottomed cylindrical shape with a small dimension in the axial direction, that is, a shallow tray shape, and covers the lower end portion (ribs 75) of the dust collecting cup main body 66 and is attached to the dust collecting cup main body 66. On the entire outer circumferential portion that is the outside portion of the cover 141, a plurality of exhaust openings 142 shaped into long slits are formed along the circumferential direction at substantially equal intervals (substantially equal angles). These exhaust openings 142 are provided plurally, for example, in two stages in the up-down direction that is the axial direction of the first centrifugally separating part 32 (dust collecting cup 19), and dispersedly discharges exhaust air that was discharged from the exhaust opening part 76 of the exhaust tube part 74 and struck the cover 141 and was then guided along the radial directions via the ribs 75 to the outside. These exhaust openings 142 are opened radially toward the radial directions of the cover 141 that are radial directions of the first centrifugally separating part 32 (dust collecting cup 19) (FIG. 16). The positions of these exhaust openings 142 are, for example, positions that do not face the ribs 75, and each plurality of exhaust openings 142 are disposed on the respective portions between the ribs 75. Further, these exhaust openings 142 are positioned on the outer circumferential portion of the lowermost end of the dust collecting cup 19, and positioned to be lower than the lower end portion of the main body handle 15.

Figure 9:
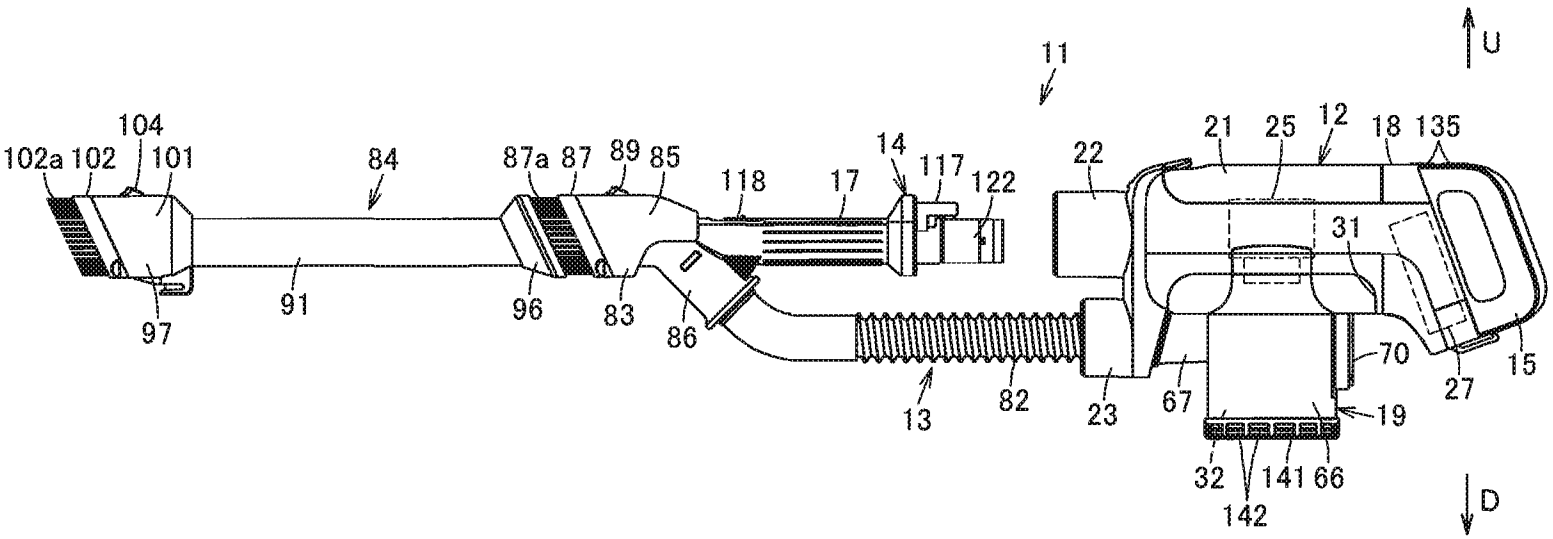
FIG. 9 is a side view showing a usage state of an electric vacuum cleaner according to a second embodiment where an air passage body is detached from a main body part at the position of a holder part.
Figure 10:
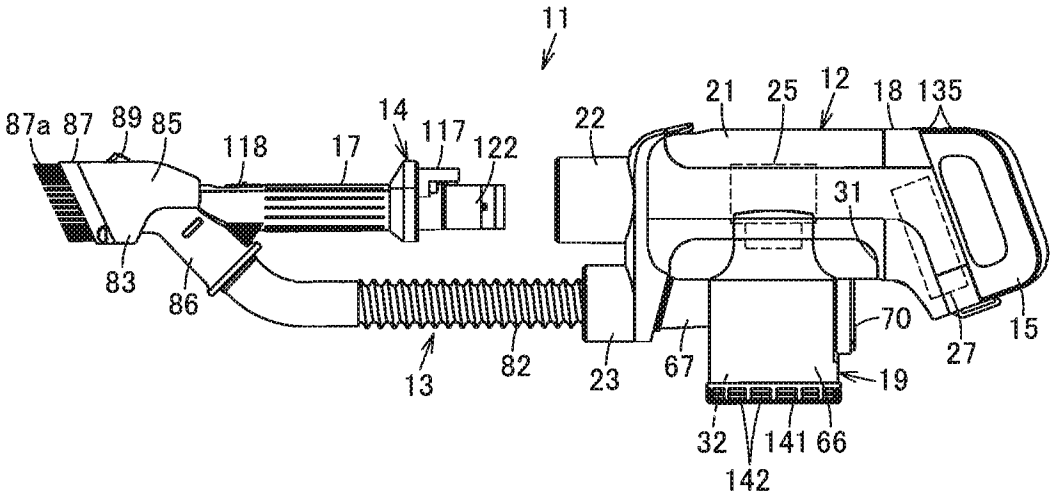
FIG. 10 is a side view showing another usage state of the same electric vacuum cleaner where the air passage body is detached from the main body part at the position of the holder part.
Figure 11:
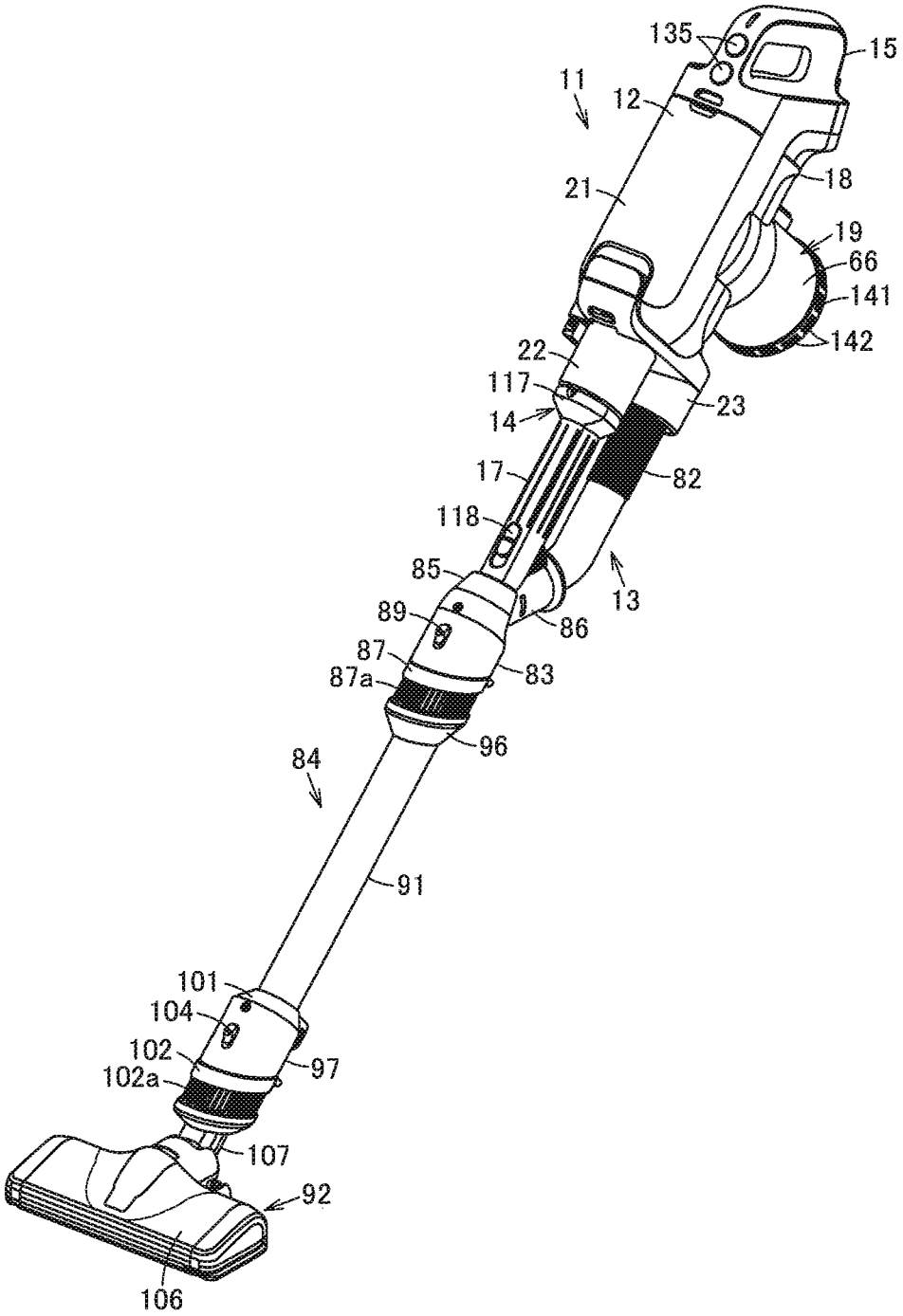
FIG. 11 is a perspective view showing a usage state of the same electric vacuum cleaner where the air passage body is attached to the main body part by the holder part.
Figure 12:
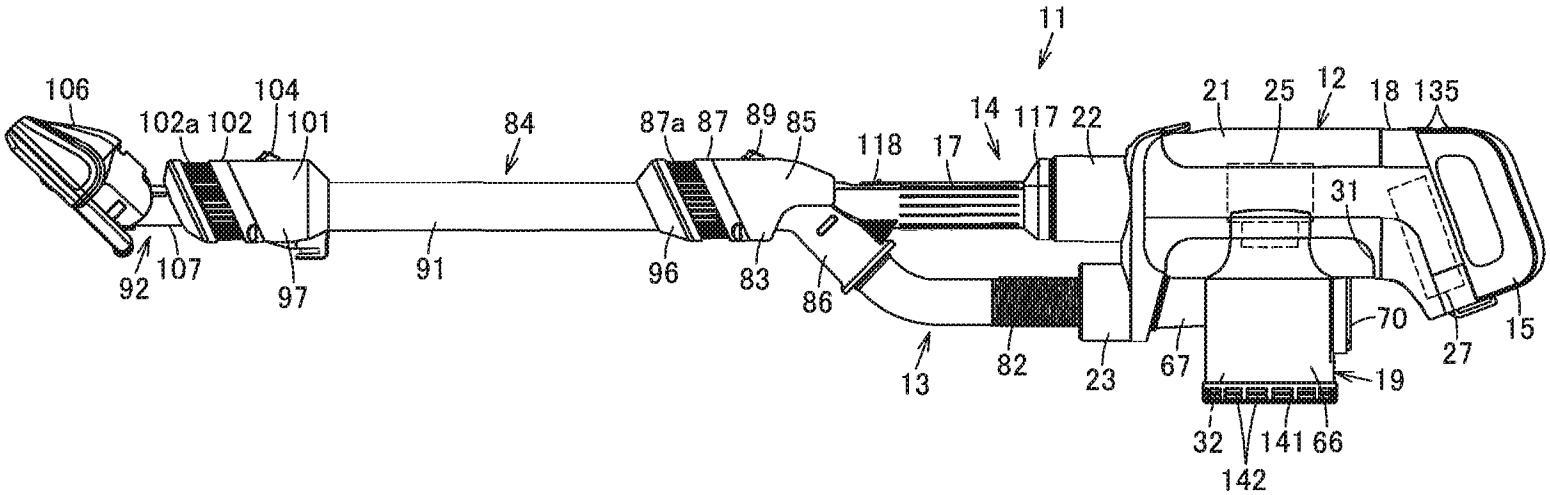
FIG. 12 is a side view showing a usage state of the same electric vacuum cleaner.
Figure 13:
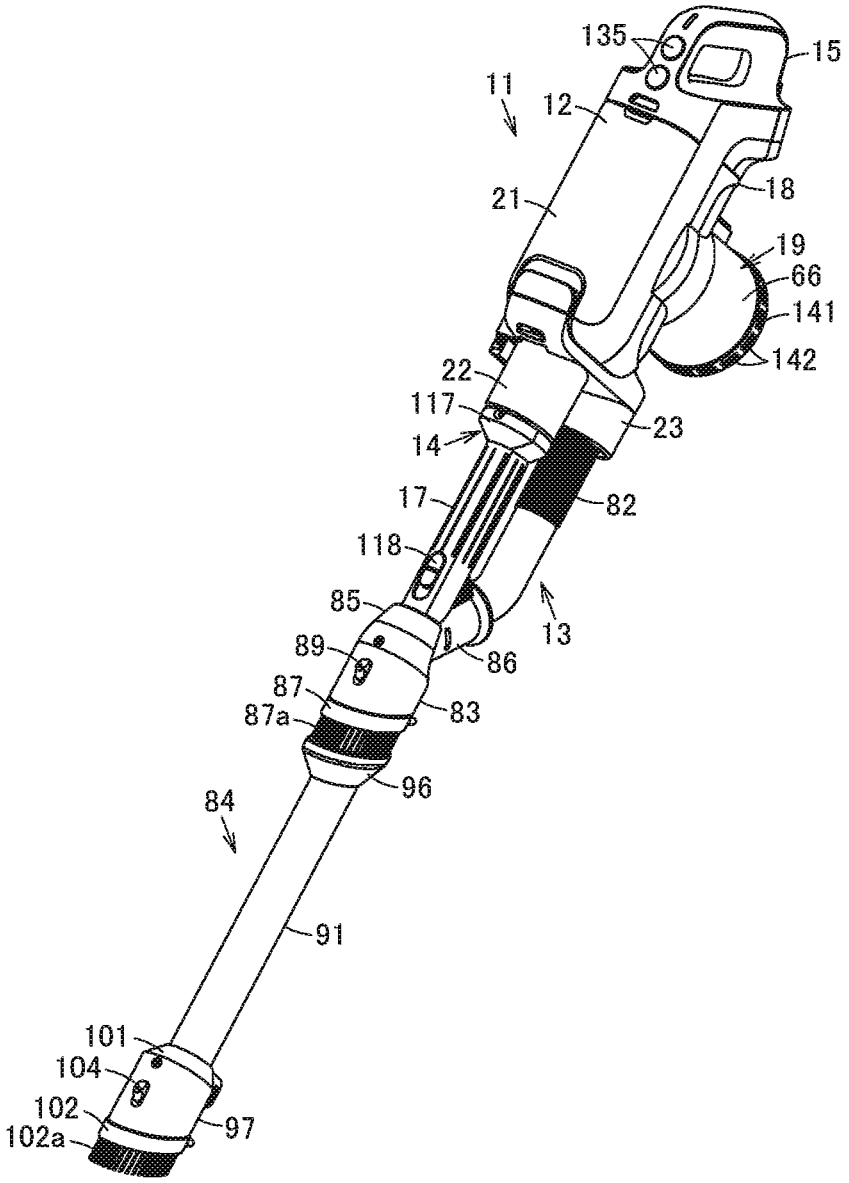
FIG. 13 is a perspective view showing another usage state of the same electric vacuum cleaner where the air passage body is attached to the main body part by the holder part.
Figure 14:
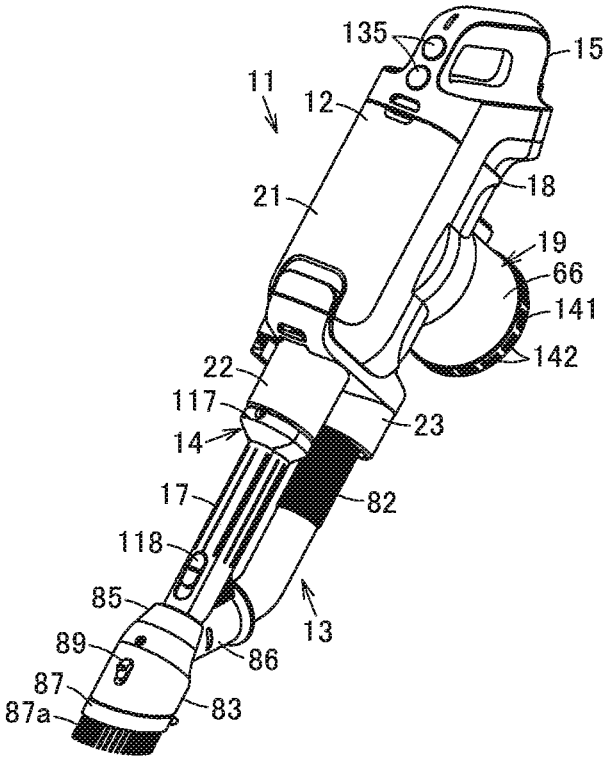
FIG. 14 is a perspective view showing still another usage state of the same electric vacuum cleaner where the air passage body is attached to the main body part by the holder part.
Figure 15:
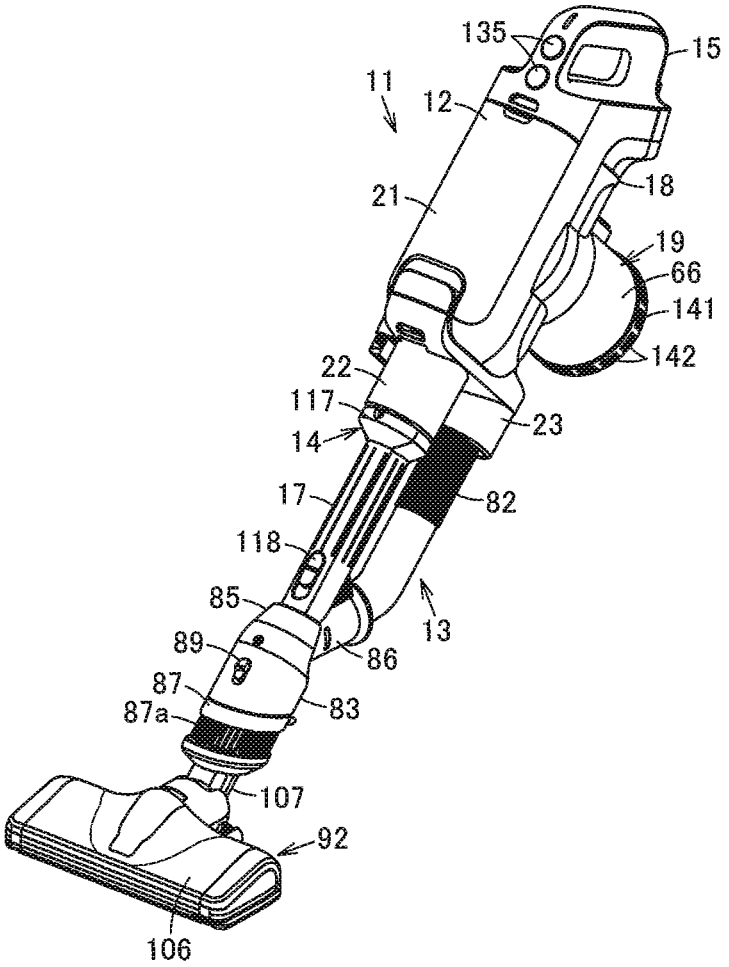
FIG. 15 is a perspective view showing still another usage state of the same electric vacuum cleaner where the air passage body is attached to the main body part by the holder part.

When cleaning, as in the first embodiment described above, to clean a surface to be cleaned of a comparatively wide area such as an indoor floor surface, as shown in FIG. 11 and FIG. 12, the air passage body 13 is attached to the main body part 12 by the holder part 14 at the position of the holder receiving part 22, cleaning is performed while the entire electric vacuum cleaner 11 is moved by gripping the main body handle 15, and according to the necessity of cleaning a narrow space into which the floor brush 92 cannot be inserted, for example, a space between furniture and a wall portion, the electric vacuum cleaner 11 is used in the state where the floor brush 92 is detached from the extension tube 91 (FIG. 13). On the other hand, to clean the surface of a table and a surface to be cleaned of a comparatively narrow area, etc., from the state shown in FIG. 11 to FIG. 13, as shown in FIG. 14, the attachment part 84 (extension tube 91 and floor brush 92) is detached in the air passage body 13, and cleaning is performed while the entire electric vacuum cleaner 11 is moved by gripping the main body handle 15. At this time, according to the necessity of the kind, etc., of the surface to be cleaned, the electric vacuum cleaner 11 can also be used in the state where only the floor brush 92 is attached to the suction port body part 83 (FIG. 15). Further, in the case of cleaning at a relatively high position, for example, a ceiling, etc., from the state shown in FIG. 13, as shown in FIG. 9, the air passage body 13 is detached from the main body part 12 by the holder part 14, and while the main body part 12 is carried and the hose body 82 of the air passage body 13 is stretched (expanded and contracted) with respect to the main body part 12, cleaning is performed with the suction port part 97 on the front end portion of the extension tube 91. Further, in the case of cleaning at a position near the hand of a user, for example, a position behind an installed article such as a television, a vehicle seat, and stairs, etc., as shown in FIG. 10, the extension tube 91 is further detached from the state shown in FIG. 9, and while the main body part 12 is carried and the hose body 82 of the air passage body 13 is stretched (expanded and contracted) with respect to the main body part 12, cleaning is performed with the suction port body part 83.

In the case of cleaning of a range that can be sufficiently reached by only stretching the hose body 82, or cleaning at a position below a bed, when the main body part 12 is not lifted by gripping the main body handle 15 but is placed on the surface to be cleaned, etc., the cover 141 acts as an antiskid device against the surface to be cleaned, so that the main body part 12 is not dragged by the contraction force of the hose body 82.

In the same manner as in the first embodiment described above, air containing dust sucked into the dust collecting cup 19 (dust collecting cup main body 66) of the first centrifugally separating part 32 is turned between the inner circumferential surface of the dust collecting cup 19 (dust collecting cup main body 66) and the outer circumferential surface of the separating body part main body 41 of the separating body part 33, and extremely large dust (coarse dust) is centrifugally separated from the air due to its own weight, and falls along the inner circumferential surface of the dust collecting cup main body 66 and is collected in the dust storing part 71 of the dust collecting cup main body 66.

The air from which dust was centrifugally separated flows into the openings 44 while passing through the separating filter 45. The air that passed through the openings 44 (separating filter 45) passes through the communicating air passage part 35 while being straightened by the smooth cylindrical outer circumference of the exhaust part 42. Further, the air that passed through the communicating air passage part 35 flows into the second centrifugally separating parts 36 (separating cylinder parts 37) via the suction opening parts 37*a*, and is turned along the inner circumferential surfaces of the separating cylinder parts 37 in the second centrifugally separating parts 36 and fine dust is further centrifugally separated. This separated dust falls from the dust discharge ports 37*b* at the lower end portions of the separating cylinder parts 37 to the fine dust receiving part 68 of the dust collecting cup 19 and is collected therein. The air from which the fine dust was separated flows from the discharge opening parts 49*a* of the discharge cylinder parts 49 on the upper end portion of the separating cylinder parts 37 into the air passage part 38, and is sucked into the intake port 25*a* of the electric blower 25 via the air passage part 38.

The air sucked into the electric blower 25 passes through the electric blower 25 while cooling it and becomes exhaust wind, and is discharged from the exhaust port to the inside of the electric blower chamber 26, and then from the discharge opening 65 at the lower portion of the electric blower chamber 26, passes downward through the inside of the separating body part 33 while being straightened by the smooth inner circumferential surfaces of the exhaust part 42 and the exhaust tube part 74, and is discharged to the outside of the dust collecting cup 19 (main body part 12) from the exhaust opening part 76, and guided to the exhaust openings 142 while being dispersed by the ribs 75, and dispersedly exhausted along the radial directions from these exhaust openings 142.

According to the second embodiment described above, in the dust collecting cup 19 of the first centrifugally separating part 32 which is provided on the lower portion of the main body part 12 and centrifugally separates dust from air containing dust sucked by the electric blower 25, along the turning axis direction, that is, in the present embodiment, along the central axis of the dust collecting cup main body 66 that turns the air containing dust, the exhaust tube part 74 which discharges exhaust air of the electric blower 25 from the bottom portion is provided, and a plurality of exhaust openings 142 are provided in the outside portion of the cover 141 attached to cover the bottom portion of the dust collecting cup 19 (dust collecting cup main body 66) including this exhaust tube part 74, and accordingly, without increasing the size of the main body part 12 more than required, an exhaust air passage from which exhaust air from the electric blower 25 can be discharged while being straightened can be formed by the exhaust tube part 74 by effectively using the space around the central axis of the first centrifugally separating part 32, and exhaust air discharged from the exhaust tube part 74 can be straightened by the cover 141 and dispersedly exhausted from the exhaust openings 142. Therefore, the exhaust air is not exhausted downward to the surface to be cleaned, and hardly blows away dust on the surface to be cleaned. In addition, the sound pressure of noise such as wind noise caused by driving of the electric blower 25 can also be attenuated due to discharge of exhaust air via the exhaust tube part 74 and the exhaust openings 142, so that quietness can be secured.

When cleaning is performed by placing the bottom portion (cover 141) of the dust collecting cup 19 of the main body part 12 on a surface to be cleaned, normally, the electric vacuum cleaner 11 is used in the state where the air passage body 13 is detached from the main body part 12 at the position of the holder part 14 and the hose body 82 is stretched. Therefore, the portion to be cleaned by using the air passage body 13 is away from the main body part 12, so that even when the cover 141 is placed on the surface to be cleaned and the exhaust openings 142 are positioned close to the surface to be cleaned, dust to be cleaned off is not blown away by the exhaust air discharged from these exhaust openings 142.

By opening the exhaust openings 142 radially toward the radial directions, exhaust air to be discharged from these exhaust openings 142 can be dispersed substantially uniformly in the radial directions of the dust collecting cup 19. Therefore, the exhaust air is not concentrated in a specific direction, but is discharged as mild exhaust air with relaxed pressure, so that it neither blows away dust nor strongly blows against a user's body.

Further, by guiding exhaust air discharged from the exhaust tube part 74 to the exhaust openings 142 by the ribs 75 projecting from the bottom portion of the dust collecting cup 19 of the first centrifugally separating part 32, even at the bottom portion of the dust collecting cup 19 at which the air flow direction suddenly changes from the axial direction of the exhaust tube part 74 to the radial directions of the dust collecting cup 19, a turbulence hardly occurs, so that the quietness can be improved.

In addition, the exhaust openings 142 are opened at positions that do not face the ribs 75, so that the exhaust air from the exhaust openings 142 is not blocked by the ribs 75, but is smoothly exhausted.

The exhaust openings 142 are positioned to be lower than the main body handle 15 for gripping the main body part 12, so that exhaust air from the exhaust openings 142 is not blown toward a hand gripping the main body handle 15, and the feeling of use can be improved.

By making the cover 141 of a soft member, for example, in the case where the electric vacuum cleaner 11 is used in the state where the air passage body 13 is detached from the main body part 12 at the position of the holder part 14, by placing the cover 141 on a surface to be cleaned, the cover 141 generates a frictional force due to the weight of the main body part 12 and acts as an antiskid device against the surface to be cleaned, so that even if cleaning is performed while the hose body 82 biased toward the contracting direction is stretched, the main body part 12 is not dragged by the contraction force of the hose body 82. Further, even in the case of this placement and in a case where the main body part 12 is dropped by mistake, the cover 141 acts as a shock absorbing member, so that the dust collecting cup 19 (dust collecting cup main body 66) is hardly broken.

In the second embodiment described above, the second centrifugally separating parts 36 are not essential constitutions, and for example, instead of the second centrifugally separating parts 36, a filter, etc., may be disposed on the downstream side of the first centrifugally separating part 32.

The exhaust openings 142 may not be provided on the front and rear portions of the cover 141 as long as they are provided on at least both side portions of the outside portion of the cover 141.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An electric vacuum cleaner comprising:

a main body part including an electric blower and an upstream side separating part that centrifugally separates dust from air containing dust sucked by the electric blower, wherein the upstream side separating part includes a cup part including a storage part that is formed into a bottomed cylindrical shape and turns air containing dust inside, and a discharge part that is formed along the central axis of the storage part and discharges exhaust air of the electric blower from the bottom portion, wherein the bottom portion is provided on the side of the upstream side separating part opposite to the electric blower.

2. The electric vacuum cleaner according to claim 1, wherein the discharge part is formed into a cylindrical shape.

3. The electric vacuum cleaner according to claim 1, wherein the upstream side separating part includes:

a separating body part that is disposed along the central axis of the storage part and turns air containing dust around it to make the air pass inward, and a cylindrical exhaust part which communicates with the upstream side of the discharge part, and at least a portion of which is disposed inside the separating body part.

4. The electric vacuum cleaner according to claim 1, wherein the electric blower is disposed so that its central axis has a component parallel to the central axis of the upstream side separating part.

5. The electric vacuum cleaner according to claim 1, wherein the main body part includes, lateral to the electric blower, a downstream side separating part that has a central axis substantially parallel to the central axis of the electric blower, communicates with the downstream side of the upstream side separating part, and centrifugally separates dust smaller than dust to be separated by the upstream side separating part.

6. The electric vacuum cleaner according to claim 1, wherein the main body part includes a plurality of downstream side separating parts that are disposed on at least a portion of the periphery of the electric blower, communicate with the downstream side of the upstream side separating part, and centrifugally separate dust smaller than dust to be separated by the upstream side separating part.

7. The electric vacuum cleaner according to claim 1, wherein the upstream side separating part has, at a position deviating from the suction side of the electric blower, a suction port through which air containing dust is introduced into the storage part.

8. The electric vacuum cleaner according to claim 1, comprising:

on the front side of the main body part, an air passage part that communicates with the upstream side separating part and guides air containing dust to the upstream side separating part, wherein the main body part includes a main body handle to be gripped, disposed on at least one of the upper portion and the rear portion, and a discharge opening that is disposed on the lower portion and communicates with the downstream side of the electric blower and the upstream side of the discharge part of the upstream side separating part.

9. The electric vacuum cleaner according to claim 1, wherein the upstream side separating part includes a cover attached to cover the bottom portion of the cup part, and the cover includes a plurality of exhaust openings on the outside portion.

10. The electric vacuum cleaner according to claim 9, wherein the exhaust openings are opened racially toward the radial directions.

11. The electric vacuum cleaner according to claim 9, wherein the upstream side separating part includes an air guide part that projects from the bottom portion of the cup part and guides exhaust air discharged from the discharge part to the exhaust openings.

12. The electric vacuum cleaner according to claim 9, wherein the main body part includes a main body handle to be gripped, and the exhaust openings are positioned to be lower than the main body handle.

13. The electric vacuum cleaner according to claim 9, wherein the cover is made of a soft member.

* * * * *